US008042498B2

(12) United States Patent
Hirayama et al.

(10) Patent No.: US 8,042,498 B2
(45) Date of Patent: Oct. 25, 2011

(54) SUPERHEATED STEAM GENERATOR

(75) Inventors: Kotaro Hirayama, Kawasaki (JP); Yoshimasa Hiramatsu, Kawasaki (JP); Takashi Kogin, Kawasaki (JP)

(73) Assignee: Dai-Ichi High Frequency Co., Ltd., Tokyo (JP)

( * ) Notice: Subject to any disclaimer, the term of this patent is extended or adjusted under 35 U.S.C. 154(b) by 893 days.

(21) Appl. No.: 11/610,205

(22) Filed: Dec. 13, 2006

(65) Prior Publication Data

US 2008/0141953 A1 Jun. 19, 2008

(51) Int. Cl.

| | |
|---|---|
| ***F22G 7/14*** | (2006.01) |
| ***F24F 9/00*** | (2006.01) |
| ***G21D 5/00*** | (2006.01) |
| ***F28F 13/00*** | (2006.01) |
| ***H05B 6/02*** | (2006.01) |

(52) U.S. Cl. ..... 122/476; 432/64; 432/148; 432/163; 432/209; 60/644.1; 60/650; 60/655; 60/678; 165/146; 165/158; 219/600

(58) Field of Classification Search ..... 122/7 R, 122/414, 460, 466, 60, 653, 476; 432/148, 432/163, 64, 209; 60/650, 644.1, 655, 678; 165/146, 158; 219/600

See application file for complete search history.

(56) References Cited

U.S. PATENT DOCUMENTS

| | | | | |
|---|---|---|---|---|
| 2,510,801 | A * | 6/1950 | Chilowsky | 310/306 |
| 2,587,530 | A * | 2/1952 | Rossi | 122/114 |
| 4,056,079 | A * | 11/1977 | Reid et al. | 122/476 |

FOREIGN PATENT DOCUMENTS

| | | | |
|---|---|---|---|
| JP | 2002270351 | A * | 9/2002 |
| JP | 2003297537 | A * | 10/2003 |

OTHER PUBLICATIONS

JP2002-270351A and JP2003-297537A are machine translation.*

* cited by examiner

*Primary Examiner* — Henry Yuen
*Assistant Examiner* — Ket D Dang
(74) *Attorney, Agent, or Firm* — Westman, Hattori, Daniels & Adrian, LLP

(57) ABSTRACT

A superheated steam generator includes an introduction section for introducing saturated steam into hollow pipe members arranged as steam flow passages and acting as inductively heated elements, and a discharge section for discharging superheated steam from the flow passages, wherein a turbulence generator is disposed in each of the steam flow passages to accelerate heat transfer to the steam in the pipe members, wherein the turbulence generator is a zigzag bent member disposed in the steam flow passage, and a zigzag bending pitch of the bent member changes from rough to minute from the introduction section to the discharge section.

7 Claims, 10 Drawing Sheets

SUPERHEATED STEAM GENERATOR

TECHNICAL FIELD

The present invention related to a superheated steam generator for generating superheated steam by further heating saturated steam such as moisture steam and the like, and more particularly, to a superheated steam generator having a heating section of a type for heating steam flowing in a plurality of conductive pipe members disposed in parallel with each other by the heat transfer from the pipe members by induction heating the pipe members. Further, the present invention relates also to a heating element and a temperature control of steam.

BACKGROUND ART

Apparatuses disclosed in, for example, Patent Document 1 are known as the superheated steam generator arranged as described above. FIGS. 1*a* to 1*c* show, as an example of the apparatuses, a structure of a superheated steam generator main body 10 having a plurality pipe members disposed in parallel with each other, the hollow portions of the pipe members being used as steam passages, and the pipe members themselves being used as heating elements, wherein FIG. 1(*a*) is a left side elevational view, FIG. 1(*b*) is a front elevational view from which insulators are removed, and FIG. 1(*c*) is a front elevational view in longitudinal cross-section of the pipe members 13 acting as heating elements and corrugated sheets 15 acting as interference members.

The superheated steam generator main body 10 (refer to FIGS. 11(*a*) and 11(*b*)) is composed of an introduction section 11 to which saturated steam is supplied, a heating section 12 for heating the saturated steam and converting it into superheated steam, and a discharge section 16 for discharging the superheated steam. The introduction section 11 and the discharge section 16 are composed of a funnel- or bugle-shaped cylindrical body to change the diameter of a steam passage. The heating section 12 includes the plurality of pipe members 13 disposed in parallel with each other and an induction coil 17 comprehensively wound around a group of the pipe members 13 through a not shown insulators. The pipe members 13 are composed of a conductive material that is induction-heated by electrifying the induction coil 17 with high frequency, and the one ends of the pipe members 13 communicate with and connect to the introduction section 11, the other ends thereof communicate with and connect to the discharge section 16, and the hollow portions 14 act as stream passages. Note that, in the superheated steam generator main body 10, the pipe members located in the outer peripheral region of the pipe group are composed of non-magnetic stainless steel and those located in the inner deep region thereof are composed of ferromagnetic carbon steel, thereby the induction heating action is executed uniformly by the induction coil 17.

The corrugated sheets 15 are disposed in the hollow portions 14 of the pipe members 13 (refer to FIG. 11(*c*)) as interference members (turbulence generation means) for disturbing the flow in the stream passages. The corrugated sheets 15 are repeatedly bent over almost the entire length of the pipe members 13 at the same pitch and at the same angle.

The induction coil 17 (refer to FIG. 11(*b*)) is also wound over almost the entire length of the heating section 12 at the same pitch. Note that there is also an apparatus in which a moisture steam generation function and a moisture steam superheat function are accommodated in a series of zone (for example, refer to Patent Document 2). In the above apparatus, however, although the winding density of the induction coil is increased in an aquiferous zone to which evaporation latent heat must be supplied, the induction coil is wound at the same pitch in a space zone in which moisture steam passing therethrough is further heated and made to superheated steam.

The superheated steam generator main body 10 is used as a superheated steam source for processing, for example, waste oil, waste plastic, kitchen refuse, food, equipment, and the like for the drying, reduction in volume, cocking, sterilization, and the like of them, thereby superheated steam is used in an increasing volume. In many case, the superheated steam generator main body 10 has a temperature control circuit affixed thereto to supply superheated steam of a temperature suitable for an object of use. A temperature control is executed by a feedback control by a PID operation (proportional/integral/differential) which can be used easily when there is only one object to be controlled, and the induction coil 17 is subjected to such a power control that a temperature of the to be controlled object is detected and the detected temperature is set to a target temperature. The temperature to be controlled is ordinarily a discharged steam temperature or a temperature of a processing section disposed behind the discharge section.

FIGS. 12(*a*) to 12(*c*) show an example when a discharged steam temperature is feedback-controlled, wherein FIG. 12(*a*) is an overall block diagram including a temperature control circuit and other associating apparatuses, FIG. 12(*b*) is a block diagram of the temperature control circuit, and FIG. 12(*c*) is a time chart of a temperature change after heating starts.

The superheated steam generator main body 10 (refer to FIG. 12(*a*)) has a heating element thermometer 21, a discharged steam thermometer 22, and a temperature control circuit 23 affixed thereto. The heating element thermometer 21 is composed of, for example, a thermocouple, is attached to the pipe member 13 acting as the heating element at the position approximately the center of the axial direction of the pipe member 13 with respect to both the outside surfaces thereof. The thermometer 22 detects the temperature of the heating element and sends the detected temperature Ta to the temperature control circuit 23. The discharged steam thermometer 22 is also composed of, for example, a thermocouple and attached to the discharge section 16 or to a superheated steam supply pipe and the like just downstream of the discharge section 16. The thermometer 22 detects the temperature of the superheated steam discharged from the superheated steam generator main body 10 and sends the detected temperature Tb to the temperature control circuit 23.

The temperature control circuit 23 (refer to FIG. 12(*b*)) is simply embodied using a temperature regulator (for example, a commercially available electronic temperature regulator) in which an alarm issue comparison operation circuit (CMP.) and a follow-up control PID operation circuit (PID) are assembled in one package. The temperature regulator includes each two sets of manual reference temperature setting means and external signal input means and is arranged such that one set value and one external signal are input to the comparison operation circuit, and the other set value and the other external signal are input to the PID operation circuit. The PID constants of the PID operation circuit, that is, a coefficient of proportion, a coefficient of an integration term, and a coefficient of a differential term can be also set manually or automatically (automatic tuning).

The temperature control circuit 23 employing the above arrangement is arranged such that a heating element upper limit temperature Sa is set to the comparison operation circuit (set value), a detected temperature Ta of the heating element thermometer 21 is input to the comparison operation circuit as an external signal, and when the detected temperature Ta exceeds the heating element upper limit temperature Sa, the comparison operation circuit issues an alarm signal Aa. Further, the temperature control circuit 23 is arranged such that a discharged steam target temperature Gb is set to the PID operation circuit, a detected temperature Tb of the discharged steam thermometer 22 is input to the PID operation circuit as an external signal, and a power command Ia is output from the comparison operation circuit so that a high frequency power supply 24 outputs a coil current Ib for causing the detected temperature Tb to approach the discharged steam target temperature Gb.

The power command Ia and the alarm signal Aa are sent from the temperature control circuit 23 to the high frequency power supply 24 which outputs the coil current Ib according to the power command Ia to the induction coil 17 of the heating section 12 of the superheated steam generator main body 10 as well as forcibly stops the output of the coil current Ib when the alarm signal Aa becomes significant.

In addition to the above-arrangement (refer to FIG. 12(*a*)), a saturated steam generator 25 is disposed upstream of the superheated steam generator main body 10 to supply saturated steam, and a superheated steam processing apparatus (superheated steam applicator) 26 is disposed downstream of the superheated steam generator main body 10 to execute processing using superheated steam.

When the superheated steam generator main body 10 arranged as described above is operated, first, the heating element upper limit temperature Sa, the discharged steam target temperature Gb and the PID constants are set to the temperature control circuit 23. The heating element upper limit temperature Sa is determined by materials and the like of the pipe members 13, and, when general-purpose austenitic stainless steel and carbon steel are used, it is set to, for example, about 600° C. to 650° C. The discharged steam target temperature Gb is determined by the specification required by the superheated steam processing apparatus 26 and set to, for example, about 200° C. to 500° C. within the range lower than the heating element upper limit temperature Sa according to a purpose of use and a state of use. Although the PID constants are fundamentally determined by the operation characteristics of the superheated steam generator main body 10 and the high frequency power supply 24, they are also adjusted in a site because they are affected by an amount of steam supplied from the saturated steam generator 25 and a temperature of steam discharged to the superheated steam processing apparatus 26.

When the superheated steam generator main body 10 and the like are operated, saturated steam is supplied from the saturated steam generator 25 to the superheated steam generator main body 10 and made to superheated steam by being heated by the superheated steam generator main body 10, and the superheated steam is supplied from the superheated steam generator main body 10 to the superheated steam processing apparatus 26, and desired processing is executed by the superheated steam processing apparatus 26 using the superheated steam.

At the time (refer to FIG. 12(*c*)), when the PID constants are appropriately set and the amount of steam is within an appropriate range, an appropriate electrification command Ia is output from the temperature control circuit 23 to the high frequency power supply 24. In response to the command, an appropriate coil current Ib is flown from the high frequency power supply 24 to the induction coil 17 of the superheated steam generator main body 10. Accordingly, the detected temperature Tb of the discharged steam thermometer 22 becomes equal to the discharged steam target temperature Gb, and the detected temperature Ta of the heating element thermometer 21 remains less than the heating element upper limit temperature Sa as long as the discharged steam target temperature Gb is not set constrainedly (refer to a solid line graph of FIG. 12(*c*))

FIGS. 13(*a*) to 13(*c*) show an example when a discharged steam temperature is feedback-controlled, wherein FIG. 13(*a*) is an overall block diagram including the temperature control circuit and other associating apparatuses, FIG. 13(*b*) is a block diagram of the temperature control circuit, and FIG. 13(*c*) is a time chart of a temperature change after heating starts.

These figures are different from the figures described above (FIGS. 12(*a*) to 12(*c*)) in that a processing section thermometer 27 is provided in placed of the discharged steam thermometer 22 and the temperature control circuit 23 is replaced with a temperature control circuit 28 in correspondence to that a to-be-controlled object is changed from a discharged steam temperature to a processing section temperature.

Although the processing section thermometer 27 is also composed of, for example, a thermocouple, it is affixed to the superheated steam processing apparatus 26 (refer to FIG. 13(*a*)), detects, for example, a steam temperature in a processing chamber or a wall temperature of the processing chamber that is a substitute of the steam temperature and sends the detected temperature Tc to the temperature control circuit 28.

Although the temperature control circuit 28 (refer to FIG. 13(*b*)) is also embodied by the same temperature regulator as the temperature control circuit 23 and an alarm issue comparison operation circuit (CMP.) is used likewise, a follow-up control PID operation circuit is used differently. More specifically, as to the comparison operation circuit, the heating element upper limit temperature Sa is set to the circuit likewise and the detected temperature Ta is set thereto as an external signal likewise, and when the detected temperature Ta exceeds the heating element upper limit temperature Sa, an alarm signal Aa is issued. As to the PID operation circuit, however, a processing section target temperature Gc is set to the circuit, the detected temperature Tc of the processing section thermometer 27 is set thereto as an external signal, and a power command Ia is output from the PID operation circuit so that the high frequency power supply 24 outputs a coil current Ib for setting the detected temperature Tc as the processing section target temperature Gc. The command and the like Ia, Aa are sent to the high frequency power supply 24 likewise the above example (refer to FIG. 13(*a*)).

Also in this case, when the superheated steam generator main body 10 and the like are operated, saturated steam is supplied from the superheated steam generator 25, superheated steam is supplied from the superheated steam generator main body 10, and processing is executed by the superheated steam processing apparatus 26 using the superheated steam. At the time (refer to FIG. 13(*c*)), when the PID constants of the temperature control circuit 28 is appropriately set and an amount of steam is within an appropriate range, an appropriate electrification command Ia is output from the temperature control circuit 28 to the high frequency power supply 24. Accordingly, an appropriate coil current Ib is flown from the high frequency power supply 24 to the induction coil 17 of the superheated steam generator main body 10, the detected temperature Tb of the processing section thermometer 27 is set to the processing section target temperature Gc, and the detected temperature Ta of the heating element thermometer 21 remains less than the heating element upper limit temperature Sa (refer to a solid line graph of FIG. 13(*c*)).

[Patent Document 1] Japanese Patent Application Laid-Open Publication No. 2002-270351 (page 1, FIG. 3)

[Patent Document 2] Japanese Patent Application Laid-Open Publication No. 2003-297537 (page 1)

DISCLOSURE OF THE INVENTION

Problems to be Solved by the Invention

In the conventional superheated steam generator arranged as described above, induction heating can be effectively executed and the apparatus can be reduced in size by arranging the plurality of heating pipe members in parallel with each other as well as a superheated steam temperature can be stabilized using the feed-back control together with the above arrangement, which acquires a favorable reputation.

In contrast, since the apparatus has various fields of utilization, it is used in various modes and various performances such as a maximum discharged steam temperature and the like are required to the apparatus. Accordingly, an apparatus having a standard specification cannot satisfy requirements in many cases. However, even in these cases, a counter-measure can be generally established by a certain policy when cost is ignored without paying attention to profitability although a range in which it can be realized by commercially available materials is limited. In the counter-measure, a desired maximum temperature is realized by securing a sufficiently high upper limit temperature Sa of the heating elements by selecting, for example, a material of the heating elements (pipe members of heating section) bringing a highly heat resistant material such as Hastelloy into view as well as by sufficiently securing induction heating power. Further, as to inexperienced novel applications, accuracy, responsiveness, and a stable operation are realized by newly designing and constructing a total control system including even a steam utilization mode on a user side.

However, the above counter-measure not only does not satisfy an actually acceptable apparatus cost but also is disadvantageous in sales and maintenance due to a delivery load resulting from that a special order must be placed to a highly resistant material and that the control system must be newly constructed, which will be also disadvantageous to the user.

Accordingly, it is necessary to increase a discharged steam temperature as higher as possible within in the range of a hardware arrangement in which no awkwardness occurs in a set price and maintenance, in other words, to improve a heat transfer efficiency for efficiently transferring the heat generated in the pipe members of the heating section to the steam in the pipe members. In addition to the above-mentioned, it is desired to create a general-purpose control system for sufficiently reflecting a realized high heat transfer efficiency to the performance of the apparatus and moreover stably operating the apparatus while coping with a new application in a short time.

First, to cope with the problem of heat transfer, when transition of a steam temperature (T) from an introduction section to a discharge section in a pipe member of a heating section was examined, it was found that a temperature increase (dT/dx) in the direction along a passage (x) from the introduction section to the discharge section greatly reduces toward the discharge section and that a degree of reduction exceeded an anticipated degree. This shows that an amount of heat transferred from the pipe member (heating element) to the stream in the pipe member was greatly reduced toward the discharge section.

It is contemplated that a temperature difference between the pipe member and the stream in the pipe member, that is, a heat transfer drive force is reduced by the increase of temperature of the steam in the pipe member in the x-direction. To compensate the reduction of the temperature difference, one of requirements A: to increase a temperature of the pipe member and B: to reduce a steam temperature in the pipe member must be satisfied. However, when it is intended to outstandingly realize the requirement A, a temperature margin between the heating element upper limit temperature Sa and the temperature of the pipe member is greatly reduced, and a temperature control cannot be actually executed appropriately. In contrast, the requirement B is encountered with a contradiction in that it conflicts in principle with that the heat transfer efficiency is primarily increased to increase the steam temperature in the pipe member.

More specifically, a first subject is to provide a measure that can increase an amount of heat transferred from the pipe member to the steam in the pipe member and thus can increase a discharged steam temperature without requiring an increase of a pipe member (heating element) temperature as an indispensable requirement.

Next, a general purpose control system that can cope with a novel application in a short time will be examined.

As described above, the conventional apparatus has been controlled by the single control system employing two measures, that is, A: to prevent breakage of the apparatus by the alarm system for preventing the pipe member (heating element) from exceeding the upper limit temperature and B: to stabilize a discharged steam temperature by the PID control. In the control system, no problem arises in the control of the system B itself. However, since both the systems A and B are independent from each other, the data of the system B is not fed back to the system A. Accordingly, when a pipe member temperature reaches the heating element upper limit temperature Sa by an unexpected variation of conditions (for example, shortage of supplied steam), the system A is operated independently of the system B, thereby electrification of an induction coil is stopped and a processing job executed using superheated steam is interrupted.

Although it is needless to say that frequent occurrence of the interruption is not preferable, the temperature excessive increase prevention system (the system A is an example of the system) itself cannot be eliminated because it is provided for the protection and safety of the apparatus. Further, the system A is scarcely operated by the variation of the conditions in an ordinary level as long as a certain temperature difference is secured in the reference temperatures of the systems A and B. However "is scarcely operated" does not mean "is not operated at all" in principle.

Accordingly, it is contemplated to arrange both the systems A and B as a multiple control system which operates depending on both the systems. However, it is difficult to realize the system in a simple fashion because a countermeasure for preventing undesired interference between both the systems is required because there is no definite difference between the feed-back properties of both the systems A and B.

That is, a second subject is to provide a control system in which a: a pipe member (heating element) temperature excessive increase prevention control and b: a discharged steam temperature control or c: a processing section temperature control can function as necessary without damaging the control objects thereof each other.

Incidentally, the control system preferably employs an analog control system. This is because superheated steam generators as the generator of the present invention are scarcely used independently as in a case of an engine cleaning stream gun, and, in many cases, they are used together with a processing section connected to the rear stage of a discharge section thereof, and moreover, the processing section is prepared by a user in many cases. More specifically, when a specific control system is already provided with the processing section, the system must be associated with (joined to) a control system of the generator in any manner, and even if the processing section has no existing control system, there are various to-be-control items according to wide variety of applications. However, a computer control system that can cope with the various cases as described may be expensive regardless that many of the functions thereof are useless, and further the computer control system also is not excellent in operability. In contrast, an analog control system can be preferably employed because it can be freely and concisely associated with the control system of the processing section afterward with a cost comparable to objects.

Means for Solving the Problems

A superheated steam generator of the present invention (claim 1) is created to solve the above problem and characterized by comprising an introduction section for introducing saturated steam, a heating section for heating the saturated steam and making it to superheated steam in which a plurality of conductive pipe members are disposed in parallel with each other, the hollow portions of the pipe members are arranged as steam flow passages, and the pipe members themselves are caused to also act as induction heating elements, a discharge section for discharging the superheated steam, and an induction coil wound around the heating section, wherein a turbulent steam flow generation means is disposed in each of the steam flow passages of the heating section to accelerate transfer of heat from the pipe members to the steam in the pipe members and generates much turbulence near to the discharge section.

A superheated steam generator of the present invention (claim 2) is the superheated steam generator according to claim 1 and further characterized in that the turbulent flow generation means is a bent member such as a corrugated sheet and the like disposed in the steam flow passage of the heating section, and a bending pitch of the bent member changes from rough to minute from the introduction section to the discharge section.

A superheated steam generator of the present invention (claim 3) is any one of the superheated steam generators according to claims 1 and 2 and further characterized in that the turbulent flow generation means is a bellows-shaped pipe wall formed of a pipe wall constituting the portion of the pipe member near to the discharge section.

A superheated steam generator of the present invention (claim 4) is any one of the superheated steam generators according to claims 1 to 3 and further characterized in that a winding density of the induction coil changes from rough to minute from the introduction section to the discharge section.

A superheated steam generator of the present invention (claim 5) is any one of the superheated steam generators according to claims 1 to 4 and further characterized by comprising a heating element thermometer that detects a temperature of a heating element comprising the pipe member of the heating section and has a detection end attached to the pipe member, a heating element temperature feed-back control circuit (feed-back control circuit of first specification) for executing an electrification control of the induction coil so that a detected temperature of the heating element thermometer converges to a heating element target temperature, a discharged steam thermometer having a detection end disposed to the discharge section or downstream of the discharge section, a discharged steam temperature feed-back control circuit (feed-back control circuit of second specification) for executing the power control of the induction coil so that the detected temperature of the discharged steam thermometer converges to a discharged steam target temperature, and a heating element discharged steam control mode switching means (control mode switching means of first specification) for setting a mode in which, when the detected temperature of the discharged steam thermometer is far from the discharged steam target temperature, the heating element temperature feed-back control circuit is employed to the power control of the induction coil and the discharged steam temperature feed-back control circuit is excluded and setting a mode in which, when the detected temperature of the discharged steam thermometer approaches the discharged steam target temperature, the heating element temperature feed-back control circuit is excluded from the power control of the induction coil and the discharged steam temperature feed-back control circuit is employed.

It should be noted that "far from the target temperature" or "approaches the target temperature" is determined depending on whether a target vicinity temperature, which is a threshold value set to an appropriate, value, is exceeded or not and the like. However, as an index of achievement, "far from the target temperature" indicates a state that a temperature increase in the heating section is less than 90% to 95% (360° C. to 380° C.) of a target amount of temperature increase (for example, a temperature increase span of 400° C. from 100° C. to 500° C.), and "approaches the target temperature" indicates a state that the temperature increase exceeds 90% to 95% on the contrary, respectively. The value from 90% to 95% may be appropriately changed depending on the temperature increase span of the heating section and thermal characteristics (heat capacity, heat transfer efficiency, control response time, and the like) and temperature increasing characteristics of the generator of the present invention.

When, for example, an amount of change of temperature per unit time (dT/dt) of a detected heating element temperature is equal to or less than 1.5 times an amount of change of temperature per unit time (dT/dt) of a detected discharged steam temperature in the vicinity of a switching point (threshold value, target vicinity temperature), there is no significant difference between the amount of change of temperature (dT/dt) of the detected heating element temperature and that of the detected discharged steam temperature in the vicinity of the switching point. Accordingly, even if the switching point is set to a low temperature side (for example, near to 90% of the temperature increase span), the detected heating element temperature seldom exceeds an upper limit temperature in a time during which the detected discharged steam temperature reaches the discharged steam target temperature from 90% of the temperature increase span. Further, a stable temperature control with a faster temperature increase time can be achieved by executing switching at 90% of the temperature increase span.

Inversely, when the amount of change of temperature per unit time (dT/dt) of the detected heating element temperature is more than 1.5 times the amount of change of temperature per unit time (dT/dt) of the detected discharged steam temperature in the vicinity of the switching point, there is a significant difference between the amount of change of temperature (dT/dt) of the detected heating element temperature and that of the detected discharged steam temperature in the vicinity of the switching point. Accordingly, when the switching point is set to the low temperature side (for example, near to 90% of the temperature increase span), there is a possibility that the detected heating element temperature exceeds the upper limit temperature in the time during which the detected discharged steam temperature reaches the discharged steam target temperature from 90% of the temperature increase span. Therefore, the switching point is preferably set to a high temperature side (for example, near to 95% of the temperature increase span). The detected heating element temperature does not exceed the upper limit temperature by setting the switching point according to the temperature increasing characteristics as described above, thereby the stable temperature control with the fast temperature increase time can be realized.

A superheated steam generator (claim 6) is the superheated steam generator according to claim 5 and further characterized by comprising a processing section thermometer having a detection end disposed to a processing section which has been disposed or is to be disposed downstream of the discharge section, a processing section temperature feed-back control circuit (feed-back control circuit of third specification) for executing the power control of the induction coil so that a detected temperature of the processing section thermometer converges to a processing section target temperature, and a heating element discharged steam processing section control mode switching means (control mode switching means of second specification) for setting mode in which, when the detected temperature of the processing section thermometer is far from the processing section target temperature, a result of employment of the heating element discharged steam control mode switching means is employed to the power control of the induction coil and the processing section temperature feed-back control circuit is excluded and setting a mode, in which, when the detected temperature of the processing section thermometer approaches the processing section target temperature, the heating element control mode, that is, discharged steam control mode switching means is excluded from the power control of the induction coil and the processing section temperature feed-back control circuit is employed.

It should be noted that "far from the target temperature" or "approaches the target temperature" is determined depending on whether a target vicinity temperature, which is a threshold value set to an appropriate value, is exceeded or not and the like. However, as an index of achievement, "far from the target temperature" indicates a state that a temperature increase in the processing section is less than 90% to 98% (270° C. to 284° C.) of a target amount of temperature increase (for example, a temperature increase span of 300° C. from 100° C. to 400° C.), and "approaches the target temperature" indicates a state that the temperature increase exceeds 90% to 98% on the contrary, respectively. The value from 90% to 98% may be appropriately changed depending on the temperature increase span and thermal characteristics (heat capacity, heat transfer efficiency, control response time, and the like) of the heating section and a structure and a capacity of a processing chamber.

When, for example, the amount of change of temperature per unit time (dT/dt) of the detected heating element temperature is equal to or less than 1.5 times an amount of change of temperature per unit time (dT/dt) of a detected processing section temperature in the vicinity of a switching point (threshold value, target vicinity temperature), there is no significant difference between the amount of change of temperature (dT/dt) of the detected heating element temperature and that of the detected processing section temperature in the vicinity of the switching point. Accordingly, even if the switching point is set to the low temperature side (for example, near to 90% of the temperature increase span), the detected heating element temperature seldom exceeds the upper limit temperature in a time during which the detected processing section temperature reaches the processing section target temperature from 90% of the temperature increase span. Further, the stable temperature control with the faster temperature increase time can be achieved by executing switching at 90% of the temperature increase span.

Inversely, when the amount of change of temperature per unit time (dT/dt) of the detected heating element temperature is more than 1.5 times the amount of change of temperature per unit time (dT/dt) of the detected processing section temperature in the vicinity of the switching point, there is a significant difference between the amount of change of temperature (dT/dt) of the detected heating element temperature and that of the detected processing section temperature in the vicinity of the switching point. Accordingly, when the switching point is set to the low temperature side (for example, near to 90% of the temperature increase span), there is the possibility that the detected heating element temperature exceeds the upper limit temperature in the time during which the detected processing section temperature reaches the processing section target temperature from 90% of the temperature increase span. Therefore, the switching point is preferably set to the high temperature side (for example, near to 98% of the temperature increase span). The detected heating element temperature does not exceed the upper limit temperature by setting the switching point according to the temperature increasing characteristics as described above, thereby the stable temperature control with the fast temperature increase time can be realized.

A superheated steam generator of the present invention (claim 7) is any one of the superheated steam generators according to claims 1 to 4 and further characterized by comprising a heating element thermometer that detects a temperature of a heating element comprising the pipe member of the heating section and has a detection end attached to the pipe member, a heating element temperature feed-back control circuit (feed-back control circuit of first specification) for executing the power control of the induction coil so that the detected temperature of the heating element thermometer converges to a heating element target temperature, a processing section thermometer having a detection end disposed to a processing section which has been disposed or is to be disposed downstream of the discharge section, a processing section temperature feed-back control circuit (feed-back control circuit of third specification) for executing the power control of the induction coil so that a detected temperature of the processing section thermometer converges to a processing section target temperature, and a heating element processing section control mode switching means (control mode switching means of third specification) for setting a mode in which, when the detected temperature of the processing section thermometer is far from the processing section target temperature, the heating element temperature feed-back control circuit is employed to the power control of the induction coil and the processing section temperature feed-back control circuit is excluded and setting a mode in which, when the detected temperature of the processing section thermometer approaches the processing section target temperature, the heating element temperature feed-back control circuit is excluded from the power control of the induction coil and the processing section temperature feed-back control circuit is employed.

It is preferable to apply the control system to a case in which a distance between the discharge section and the processing section is short, a case in which the processing section has a small volume, and the like, that is, to a case in which there is no significant difference between the amount of change of temperature per unit time (dT/dt) of the detected heating element temperature and the amount of change of temperature per unit time (dT/dt) of the detected processing section temperature in the vicinity of the switching point. This is because when there is a significant difference therebetween in the vicinity of the switching point, the detected heating element temperature greatly varies to the amount of change of temperature of the detected processing section temperature, and there is a possibility that the detected heating element temperature exceeds the heating element upper limit temperature. In this case, it is recommended to employ the control system according to claim 5 or 6.

It should be noted that "far from the target temperature" or "approaches the target temperature" is determined depending on whether a target vicinity temperature, which is a threshold value set to an appropriate value, is exceeded or not and the like. However, as an index of achievement, "far from the target temperature" indicates a state that a temperature increase in the processing section is less than 90% to 98% (270° C. to 284° C.) of the target amount of temperature increase (for example, a temperature increase span of 300° C. from 100° C. to 400° C.), and "approaches the target temperature" indicates a state that the temperature increase exceeds 90% to 98% on the contrary, respectively. The value from 90% to 98% may be appropriately changed depending on the temperature increase span and thermal characteristics (heat capacity, heat transfer efficiency, control response time, and the like) of the heating section and the structure and the capacity of the processing chamber.

When, for example, the amount of change of temperature per unit time (dT/dt) of the detected heating element temperature is equal to or less than 1.5 times the amount of change of temperature per unit time (dT/dt) of the detected processing section temperature in the vicinity of a switching point (threshold value, target vicinity temperature), there is no significant difference between the amount of change of temperature (dT/dt) of the detected heating element temperature and that of the detected processing section temperature in the vicinity of the switching point. Accordingly, even if the switching point is set to the low temperature side (for example, near to 90% of the temperature increase span), the detected heating element temperature seldom exceeds the upper limit temperature in the time during which the detected processing section temperature reaches the processing section target temperature from 90% of the temperature increase span. Further, the stable temperature control with the faster temperature increase time can be achieved by executing switching at 90% of the temperature increase span.

Inversely, when the amount of change of temperature per unit time (dT/dt) of the detected heating element temperature is more than 1.5 times the amount of change of temperature per unit time (dT/dt) of the detected processing section temperature in the vicinity of the switching point, there is the significant difference between the amount of change of temperature (dT/dt) of the detected heating element temperature and that of the detected processing section temperature in the vicinity of the switching point. Accordingly, when the switching point is set to the low temperature side (for example, near to 90% of the temperature increase span), there is the possibility that the detected heating element temperature exceeds the upper limit temperature in the time during which the detected processing section temperature reaches the processing section target temperature from 90% of the temperature increase span. Therefore, the switching point is preferably set to the high temperature side (for example, near to 98% of the temperature increase span). The detected heating element temperature does not exceed the upper limit temperature by setting the switching point according to the temperature increasing characteristics as described above, thereby the stable temperature control with the fast temperature increase time can be realized.

A superheated steam generator of the present invention is any one of the superheated steam generators according to claims 5 to 7 and further characterized by comprising a heating element upper limit control mode switching means (control mode switching means of fourth specification) for employing the heating element temperature feed-back control circuit in the power control of the induction coil and excluding the discharged steam temperature feed-back control circuit and the processing section temperature feed-back control circuit from the power control of the induction coil when the detected temperature of the heating element thermometer deviates upward from a management range of the heating element target temperature in a state that the heating element temperature feed-back control circuit (feed-back control circuit of first specification) is excluded from the power control of the induction coil and any one of the discharged steam temperature feed-back control circuit (feed-back control circuit of second specification) and the processing section temperature feed-back control circuit (feed-back control circuit of third specification) is employed in the power control of the induction coil.

Advantages

According to the inventions of claims 1 to 3, a heat transfer property (a reciprocal number of a thermal resistance relating to heat transfer) from the pipe member (heating element) to the steam in the pipe member is more accelerated near to the discharge section than near to the introduction section because the turbulence generating means generates much turbulence near to the discharge section. As a result, when an amount of heat input to the pipe member by induction heating is unchanged (that is, power consumption is unchanged), an amount of heat transferred to the steam in the pipe member increases in proportion to the heat transfer property, and a discharged steam temperature can be increased accordingly. At the time, a pipe member temperature is reduced by an increased amount of transferred heat having been output. That is, the discharged steam temperature can be increased in a state that the pipe member temperature is rather reduced.

Next, according to the invention of claim 4, an increase in the winding density of the induction coil near to the discharge section increases an amount of heat input to the pipe member by induction heating. Thus, when the amount of heat input increased by induction heating can compensate the pipe member temperature reduced by the operation of the inventions of claims 1 to 3, the pipe member temperature can be restored to the original pipe member temperature before the temperature is reduced by the increase of the amount of transferred heat. At the same time, the increase of heat transferred from the pipe member to the steam in the pipe member and thus the increase of the discharged steam temperature are added in correspondence to the increased heat input to the pipe member. That is, a further increase of the discharged steam temperature is realized while keeping the pipe member temperature constant, thereby the first subject can be solved more sophisticatedly.

Further, in the inventions of claims, temperature control feed-back circuits such as the PID operation circuits and the like are disposed to the respective heating element, discharged steam, and processing sections. When operation starts, a heating element temperature is subjected to a feedback control by the heating element temperature feed-back control circuit (feed-back control circuit of first specification) to thereby maintain the heating element to the target temperature. When a discharged steam temperature approaches the target temperature, after an object to be controlled is switched from the heating element temperature to the discharged steam temperature, the discharged steam temperature is subjected to a feed-back control by the discharged steam temperature feed-back control circuit (feed-back control circuit of second specification) and maintained to the target temperature. Further, when a processing section temperature approaches the target temperature, after an object to be controlled is switched from the discharged steam temperature to the processing section temperature, the discharged steam temperature is subjected to a feed-back control by the processing section temperature feed-back control circuit (feed-back control circuit of third specification) and maintained to the target temperature.

Further, in particular, in the invention of claims, the discharged steam temperature feed-back control circuit (feed-back control circuit of second specification) is omitted. Thus, when operation starts, the heating element temperature is subjected to the feed-back control by the heating element temperature feed-back control circuit (feed-back control circuit of first specification) and maintained to the target temperature. When the processing section temperature approaches the target temperature, after an object to be controlled is switched from the heating element temperature to the processing section temperature, the processing section temperature is subjected to the feed-back control by the processing section temperature feed-back control circuit (feed-back control circuit of third specification) and maintained to the target temperature.

When an object to be feed-back controlled is switched from the heating element temperature to the discharged steam temperature or to the processing section temperature by the heating element discharged steam control mode switching means (control mode switching means of first specification), the heating element discharged steam processing section control mode switching means (second), and the heating element processing section control mode switching means (third), the heating element temperature is excluded from an object to be controlled. However, since the heating element temperature is in a stable state just before they are switched, even if the heating element temperature is excluded from the object to be controlled, it is less varied and there is not a possibility that it exceeds the upper limit temperature.

Since the temperature feed-back control circuits are disposed to the respective desired sections and the objects to be controlled are switched in a target temperature achieved sequence, the heating element temperature does not exceed the upper limit temperature even in an initial temperature increase after operation and even if conditions are unexpectedly varied (shortage and interruption of stream supply). Further, since the feed-back controls such as the PID controls and the like are executed in the desired sections, a temperature control excellent in responsiveness can be achieved, and even if an object to be controlled is added behind the processing section, a temperature control excellent in responsiveness can be easily achieved by adding a temperature control feed-back control such as a PID operation circuit and the like afterward without reconstructing an overall control system.

As described above, according to the present invention, there can be realized the superheated steam generator which is excellent in temperature control responsiveness and usability and can appropriately prevent super heat of the heating element.

Best Mode for Carrying Out the Invention

An arrangement of an embodiment (first embodiment) of a superheated steam generator of the present invention will be explained with reference to the figures. FIG. 1(*a*) is a left side elevational view, FIG. 1(*b*) is a front elevational view from which insulators are removed, and FIG. 1(*c*) is a left side elevational view in longitudinal cross section, and FIG. 1(*d*) is a front elevational view in longitudinal cross section.

Note that, in the illustrated embodiment, since the same components as those of the conventional apparatus are denoted by the same reference numerals, the embodiment will be described concentrating on the points thereof different from those of the conventional apparatus omitting duplicate description.

The superheated steam generator 30 is different from the conventional apparatus 10, which is described above and shown in FIGS. 11(*a*) and 11(*b*), in that the induction coil 17 is replaced with an induction coil 31 whose winding state is different from the conventional apparatus 10. Note that although FIGS. 1(*c*) and 1(*d*) show insulators 18 wound around inside and outside of the induction coil 31, they are conventionally disposed there.

Although the induction coil 31 is composed of a steel pipe and the like that can be cooled with water and wound around the outer periphery of pipe members 13 in a heating section 12 likewise the conventional induction coil, the winding density of the induction coil 31 is not uniform and made rough near to an introduction section 11 and dense near to a discharge section 16. The ratio of a dense winding density to a rough winding density is preferably, for example, 1:2 to 1:4, although it depends on a temperature difference between saturated steam and superheated steam.

A mode of use and operation of the superheated steam generator 30 of the embodiment (first embodiment) will be explained with reference to the figures. FIG. 1(*e*) is a front elevational view in longitudinal cross section of a main portion showing a flow of steam.

In the superheated steam generator main body 10, when saturated steam 5 is supplied thereto from a not shown saturated steam generator disposed upstream, the saturated steam 5 is captured by the introduction section 11, is heated in the heating section 12 and made to superheated steam 6 while it is being passed through the hollow portions 14 of the pipe members 13, and the superheated steam 6 is discharged from the discharge section 16 and supplied to a not shown superheated steam processing apparatus and the like disposed downstream. The saturated steam 5 is heated in the heating section 12 by induction-heating the pipe members 13 by electrifying the induction coil 31 with high frequency so that the heat of the pipe members 13 is transferred from the pipe members 13 to the steam in the hollow portions 14.

In this case, a small amount of heat is input near to the introduction section 11 and a large amount of heat is input near to the discharge section 16 by the induction heating depending on a rough or minute density of the wound induction coil 31, thereby a heat transfer efficiency from the pipe members 13 to the hollow portions 14 is improved and thus an overall heating efficiency of the heating section 12 is also improved. As a specific example, when saturated steam of 100° C. is heated to superheated steam of 500° C., a specific heat is about 1.2 times, a density is reduced to about one half, and a flow rate is increased to about two times in the steam. When the pipe members 13 had a length of 500 mm and the induction coil 17 was wound therearound, power of 20 kW was input and steam passed through the pipe members 13 at a speed of 50 ms. However, when the induction coil 31 was wound at a winding ration of 1:2, saturated steam 5 passed through the pipe members 13 at a speed of 25 ms and made to desired superheated steam 6, and input power was 18 kW which was smaller than the conventional one.

An arrangement of another embodiment (second embodiment) of the superheated steam generator of the present invention will be explained with reference to the figures. FIGS. 2(*a*) and 2(*b*) show a partial structure of a pipe member and an interference member, wherein FIG. 2(*a*) is a left side elevational view and FIG. 2(*b*) is a front elevational view in longitudinal cross section.

The superheated steam generator is different from the conventional apparatus 10 in that the corrugated sheet 15 accommodated in the hollow portion 14 of the pipe members 13 as an interference member is replaced with a corrugated sheet 32 having a different bending state.

Although the corrugated sheet 32 is made by bending a band-shaped plate member similar to a conventional one, it is bent roughly near to an introduction section 11 and densely near to a discharge section 16. For example, the sheet is bent every several centimeters at the end of the introduction section 11, whereas it is bent every several millimeters at the end of the discharge section 16.

The corrugated sheet 32 can be made at cost similar to the conventional corrugated sheet 15 and generates a larger disturbance in a stream flow passage near to the introduction section 11 than near to the discharge section 16 in a heating section 12.

Accordingly, when saturated steam 5 is heated and made to the superheated steam 6 while it is caused to pass through the hollow portion 14 of the pipe member 13 in the heating section, a heat transfer efficiency and a heating efficiency are more improved near to the discharge section 16. The other arrangements of the superheated steam generator is the same as the superheated steam generator 30 described above.

An arrangement of still another embodiment (third embodiment) of the superheated steam generator of the present invention will be explained with reference to the figures. FIGS. 3(*a*) and 3(*b*) show a partial structure of a pipe member and an interference member, wherein FIG. 3(*a*) is a left side elevational view, and FIG. 3(*b*) is a front elevational view in longitudinal cross section.

An interference bar 33 is assembled to a pipe member 13 as a dedicated interference member, and a bellows-shaped member 34 is coupled with the interference bar 33 as a dual purpose interference member. Any of the interference members 33, 34 is disposed to the end of the pipe member 13 on a discharge section 16 side thereof. That is, the interference bar 33 is attached to a hollow portion 14 at the end of the discharge section 16 of the pipe members 13 in a cross-shape, and the bellows-shaped member 34 is composed of a telescopic bellows pipe and attached to the end surface of the discharge section 16 of the pipe member 13 so as to extend the pipe members 13.

In this case, the bellows-shaped member 34 is assembled as the extending portion of the pipe members 13 which forms a steam flow passage of a heating section 12. Accordingly, when the pipe member 13 generates heat and extends, since the bellows-shaped member 34 is contracted by being pressed by the pipe member 13, the affect of thermal expansion of the pipe member 13 is eliminated or eased by the bellows-shaped member 34.

Further, a large disturbance is caused in the flow of steam near to the discharge section 16 of the heating section 12 by the interference bar 33 and the bellows-shaped member 34. Accordingly, when saturated steam 5 is heated and made to superheated steam 6 while it is caused to pass through the hollow portion 14 of the pipe member 13, a heating efficiency is more improved near to the discharge section 16. The other arrangements of the superheated steam generator is the same as the superheated steam generator 30 described above.

An arrangement of a further embodiment (fourth embodiment) of the superheated steam generator of the present invention will be explained with reference to the figures. FIG. 4(*a*) is a left side elevational view in longitudinal cross section of a main portion, and FIG. 4(*b*) is a front elevational view in longitudinal cross section. Further, FIG. 5(*a*) is an overall block diagram of including a temperature control circuit and other associating apparatuses, and 5(*b*) is a block diagram of the temperature control circuit.

The superheated steam generator 40 is different from the superheated steam generator 30, which is described above and shown in FIG. 1, in that the heating element thermometer 21 is replaced with a heating element thermometer 41 attached to a different position (refer to FIG. 4).

Further, the superheated steam generator 40 is also different from the superheated steam generator 30 in that a temperature control circuit 50 affixed to the superheated steam generator 40 executes a feed-back control while switching three temperature regulators 51, 52, 53 by switching circuits 54 and 55 (FIG. 5).

The heating element thermometer 41 is also composed of the same thermocouple as, for example, the heating element thermometer 21. However, the heating element thermometer 41 is attached near to a discharge section 16 on the outer peripheral surface of a pipe member 13 (refer to FIG. 4), detects a temperature of the pipe member 13 acting as a heating element, and sends the detected temperature Ta to the temperature control circuit 50 (refer to FIG. 5). The attachment position of the heating element thermometer 41 is preferably the position where an induction coil 31 has a highest winding density near to the discharge section 16 (refer to FIG. 4(*b*)). The discharged steam thermometer 22 and a processing section thermometer 27 described above are also disposed in addition to the heating element thermometer 41, and temperatures Tb and Tc detected thereby are also sent to the temperature control circuit 50 (refer to FIG. 5(*a*)).

The temperature control circuit 50 (refer to FIG. 5(*b*)) is composed of the temperature regulators 51, 52, and 53 and the switching circuits 54 and 55. The temperature regulator 51 is responsible for an issue of alarm as to a heating element temperature and for a feed-back control, the temperature regulator 52 is responsible for a feed-back control of a discharged steam temperature and for determination of employment of the control, the temperature regulator 53 is responsible for a feed-back control of a processing section temperature and determination of employment of the control, the switching circuit 54 is composed of, for example, a relay circuit or the like and executes the employment according to the determination of the temperature regulator 52 and operates as a two input/one output selector, and the switching circuit 55 is composed of, for example, a relay circuit or the like and executes the employment according to the determination of the temperature regulator 53 and operates as a two input/one output selector.

Although the temperature regulators 51, 52, and 53 are the same regulators as those described above as to the temperature control circuits 23 and 28, respectively, different set temperatures and different external signals are allocated thereto. Specifically, in the temperature regulator 51, the detected temperature Ta of the heating element thermometer 41 is input to a comparison operation circuit (CMP.) and a PID operation circuit (PID) as an external signal, and further a heating element target temperature Ga is set to the PID operation circuit. Accordingly, a power command Ia is output from the PID operation circuit to a high frequency power supply 24 so that it outputs a coil current Ib for making the detected temperature Ta equal to the heating element target temperature Ga (heating element temperature feed-back control circuit, feed-back control circuit of first specification). Further, since a heating element upper limit temperature Sa is set to the comparison operation circuit, when the detected temperature Ta exceeds the heating element upper limit temperature Sa, an alarm signal Aa is output from the comparison operation circuit The heating element target temperature Ga is set to a value that is obtained by subtracting a temperature variation of the pipe member 13 and a margin for safety, for example, 50° C. to 100° C. from the heating element upper limit temperature Sa and is a temperature lower than the heating element upper limit temperature Sa.

In the temperature regulator 52, the detected temperature Tb of the discharged steam thermometer 22 is input to a comparison operation circuit and to a PID operation circuit as an external signal, and further a discharged steam target temperature Gb is set to the PID operation circuit. Accordingly, an power command Ta is output from the PID operation circuit to the high frequency power supply 24 so that it outputs a coil current Ib for making the detected temperature Tb equal to the discharged steam target temperature Gb (discharged steam temperature feed-back control circuit, feed-back control circuit of second specification). Further, since a target vicinity temperature Sb is set to the comparison operation circuit, when the detected temperature Tb exceeds the target vicinity temperature Sb, an employment determination signal Ab is output from the comparison operation circuit. The target vicinity temperature Sb is set to a value slightly lower, for example, 100° C. to 200° C. lower than the discharged steam target temperature Gb, and this degree of temperature difference can be compensated by promptly increasing the discharged steam temperature by the feed-back control without overheating the pipe member 13.

In the temperature regulator 53, the detected temperature Tc of the processing section thermometer 27 is input to the comparison operation circuit and the PID operation circuit as an external signal, and further a processing section target temperature Gc is set to the PID operation circuit is used. Accordingly, an electrification command Ia is output from the PID operation circuit to the high frequency power supply 24 so that it output a coil current Ib for making the detected temperature Tc equal to the processing section target temperature Gc (processing section feed-back control circuit, feed-back control circuit of third specification) Further, a target vicinity temperature Sc is set to the comparison operation circuit, when a detected temperature Tc exceeds the target vicinity temperature Sc, an employment determination signal Ac is output from the comparison operation circuit. The target vicinity temperature Sc is set to a value slightly lower, for example, 10° C. to 20° C. than the processing section target temperature Gc, and this degree of temperature difference can be compensated by promptly increasing the processing section temperature by the feed-back control without overheating the pipe member 13.

The outputs from the PID operation circuits of the temperature regulators 51 and 52 are input to the switching circuit 54 as signal inputs, and the employment determination signal Ab output from the comparison operation circuit of the temperature regulator 52 is input thereto as a control input. Accordingly, when the employment determination signal Ab is insignificant, the switching circuit 54 employs and outputs the output from the PID operation circuit of the temperature regulator 51, whereas when the employment determination signal Ab is significant, the switching circuit 54 employs and outputs the output from the PID operation circuit of the temperature regulator 52. A heating element discharged steam control mode switching means (control mode switching means of first specification) is composed of the switching circuit 54 and the comparison operation circuit of the temperature regulator 52. With this arrangement, when the detected temperature Tb of the discharged steam thermometer 22 is equal to or less than the target vicinity temperature Sb and far from the discharged steam target temperature Gb, the heating element temperature feed-back control circuit composed of the PID operation circuit of the temperature regulator 51 is employed to the electrification control of the induction coil 31, and the discharged steam temperature feed-back control circuit composed of the PID operation circuit of the temperature regulator 52 is excluded. Further, when the detected temperature Tb of the discharged steam thermometer 22 exceeds the target vicinity temperature Sb and approaches the discharged steam target temperature Gb, the heating element temperature feed-back control circuit is excluded from the electrification control of the induction coil 31, and the discharged steam temperature feed-back control circuit is employed to the power control of the induction coil 31 in place of it.

In the switching circuit 55, the output from the switching circuit 54 and the output from the PID operation circuit of the temperature regulator 53 are used as signal inputs, and the employment determination signal Ac output from the comparison operation circuit of the temperature regulator 53 is used as a control input. When the employment determination signal Ac is insignificant, the output from the switching circuit 54 is employed and output, whereas when the employment determination signal Ac is significant, the output from the PID operation circuit of the temperature regulator 53 is employed and output. A heating element control mode, that is, discharged steam processing section control mode switching means (control mode switching means of second specification) is composed of the switching circuit 55 and the comparison operation circuit of the temperature regulator 53. With this arrangement, when the detected temperature Tc of the processing section thermometer 27 is equal to or less than the target vicinity temperature Sc and far from the processing section target temperature Gc, the result of employment of the switching circuit 54 is employed to control the power of the induction coil 31, and a processing section temperature feed-back control circuit composed of the PID operation circuit of the temperature regulator 53 is excluded. Further, when the detected temperature Tc of the processing section thermometer 27 exceeds the target vicinity temperature Sc and approaches the processing section target temperature Gc, any of the result of employment of the switching circuit 54, that is, the heating element temperature feed-back control circuit and the discharged steam temperature feed-back control circuit is excluded, and the processing section temperature feed-back control circuit is employed to the power control of the induction coil 31 in place of it.

A mode of use and operation of the superheated steam generator 40 of the embodiment (fourth embodiment) will be explained with reference to the figures. FIG. 6 is a time chart of a temperature change.

The superheated steam generator 40 is arranged such that when saturated steam is supplied thereto from an upstream saturated steam generator 25, the saturated steam is captured by an introduction section 11, is heated in a heating section 12 and made to superheated steam while it is being passed through the hollow portion 14 of the pipe member 13, and the superheated steam is discharged from a discharge section 16 and supplied to a downstream superheated steam processing apparatus 26. The saturated steam is heated in the heating section 12 by induction-heating the pipe member 13 by electrifying the induction coil 31 with high frequency so that the heat of the pipe member 13 is transferred from the pipe member 13 to the steam in the hollow portion 14. A small amount of heat is input near to the introduction section 11 and a large amount of heat is input near to the discharge section 16 depending on the rough or minute density of the wound induction coil 31, thereby the saturated steam is effectively heated.

At the time, although the temperature of the pipe member 13 is higher on the discharge section 16 side than on the introduction section 11 side, the temperature is detected by the heating element thermometer 41 and this detected temperature Ta is devoted by the feedback control executed by the temperature control circuit 50 and the comparison operation circuit of the temperature regulator 51 of the temperature control circuit 50 to monitor overheat. There is less possibility that the pipe member 13 acting as the heating element is abnormally heated, and further even if begins to be overheated, when the detected temperature Ta of the heating element thermometer 41 exceeds the heating element upper limit temperature Sa, the alarm signal Aa is sent to the high frequency power supply 24 at once, thereby the pipe member 13 and the like can be prevented from being damaged.

Further, in the temperature control executed by the temperature control circuit 50, the heating element temperature feed-back control circuit, the discharged steam temperature feed-back control circuit, and the processing section feed-back control circuit are selectively employed. Specifically, when the superheated steam generator main body 10 and the like are operated (refer to time t0 of FIG. 6), at the time, the detected temperature Tb is equal to or less than the target vicinity temperature Sb and the detected temperature Tc is equal to or less than the target vicinity temperature Sc. Thus, first, the heating element temperature feed-back control circuit is employed, thereby the detected temperature Ta of the heating element thermometer 41 is controlled to increase to the heating element target temperature Ga and maintained at the temperature. During the time in which the control continues (time t0 to t1), since the induction coil 31 is electrified with high frequency within the range in which the heating element temperature does not exceed the heating element upper limit temperature Sa, the detected temperature Tb of the discharged steam thermometer 22 and the detected temperature Tc of the processing section thermometer 27 also continuously increase.

When the detected temperature Tb approaches the discharged steam target temperature Gb and exceeds the target vicinity temperature Sb (refer to time t1 of FIG. 6), the discharged steam temperature feed-back control circuit is employed in place of the heating element feed-back control circuit, thereby the detected temperature Tb of the discharged steam thermometer 22 is controlled to increase to the discharged steam target temperature Gb and to be maintained at the temperature (time t1 to t2). Just after the former control circuit is switched to the latter control circuit, the coil current Ib increases, and thus the detected temperature Ta of the heating element thermometer 41 increases. However, when the detected temperature Tb of the discharged steam thermometer 22 reaches the discharged steam target temperature Gb shortly, since the coil current Ib reduces, the detected temperature Ta of the heating element thermometer 41 is also settled without exceeding the heating element upper limit temperature Sa.

Thereafter, when the detected temperature Tc of the processing section thermometer 27 approaches the processing section target temperature Gc and exceeds the target vicinity temperature Sc (refer to time t2 of FIG. 6), the processing section temperature feed-back control circuit is employed in place of the discharged steam temperature feed-back control circuit, thereby the detected temperature Tc of the processing section thermometer 27 is controlled to increase to the processing section target temperature Gc and to be maintained at the temperature (time from t2). Just after the former control circuit is switched to the latter circuit, the coil current Ib increases, and thus the detected temperature Ta of the heating element thermometer 41 increases. However, when the detected temperature Tc of the processing section thermometer 27 reaches the processing section target temperature Sc shortly, since the coil current Ib reduces, the detected temperature Ta of the heating element thermometer 41 is also settled without exceeding the heating element upper limit temperature Sa. Thereafter, the feed-back control is continued, and superheated steam of a desired temperature is supplied to the superheated steam processing apparatus 26.

As described above, in the superheated steam applicator 40 with the temperature control circuit 50, first, the heating element temperature is subjected to the feed-back control by the PID operation circuit of the temperature regulator 51, thereby the temperature of the heating element is promptly increased while preventing the heating element from being overheated. Subsequently, when there is not a possibility that the heating element is overheated, the discharged steam temperature is subjected to the feed-back control by the PID operation circuit of the temperature regulator 52, thereby the discharged steam temperature is promptly increased. Further, when there is not a possibility that the heating element is overheated, the processing section temperature is subjected to the feed-back control by the PID operation circuit of the temperature regulator 53, thereby the processing section temperature is promptly increased. Thereafter, the processing section temperature is maintained at the target temperature by the feed-back control.

More specifically, the temperature control is achieved by closing only one loop sequentially selected from the triple open/close type feed-back loop. Accordingly, the PID constants of the PID operation circuits of the temperature regulators 51, 52, and 53 can be set without taking interference with other feed-back loops into consideration assuming that there is only one feed-back loop. As a result, the embodiment can be simply applied to various applications likewise the conventional embodiment.

Further, an arrangement of a still further embodiment (fifth embodiment) will be explained with reference to the figures. The superheated steam generator of the embodiment further includes a processing section thermometer 27 shown in FIG. 13 and a processing section temperature feed-back control circuit (feed-back control circuit of third specification) in which the temperature regulator 53 shown in FIG. 5 is disposed and which controls a processing section temperature based on a detected temperature Tc of the processing section thermometer 27, in addition to the arrangement of the basic apparatus shown in FIG. 4. The superheated steam generator also includes a heating element temperature feed-back control circuit (feed-back control circuit of first specification) in which the temperature regulator 51 shown in FIG. 5 is disposed and which controls a heating element temperature based on a detected temperature Ta of a heating element thermometer 41.

FIG. 7(*a*) is an overall block diagram, and FIG. 7(*b*) is a block diagram of a temperature control circuit 58. Although the processing section thermometer 27 and the heating element thermometer 41 remain in a temperature control circuit 58, since a discharged steam thermometer 22 is omitted therefrom, the temperature control circuit 58 is arranged by omitting the temperature regulator 52 and the switching circuit 54 from the temperature control circuit 50 described above. Since the switching circuit 54 is omitted, an input to the switching circuit 55 is altered, and thus the switching circuit 55 is arranged as a switching circuit 56 as described below. More specifically, outputs from PID operation circuits of temperature regulators 51 and 53 are input to the switching circuit 56 as input signals, and an employment determination signal Ac output from a comparison operation circuit of the temperature regulator 53 is input to the switching circuit 56 as a control input. When the employment determination signal Ac is insignificant, the switching circuit 56 employs the output from the PID operation circuit of the temperature regulator 51 and outputs it, whereas when the employment determination signal Ac is significant, the switching circuit 56 employs the output from the PID operation circuit of the temperature regulator 53 and outputs it.

A heating element processing section control mode switching means (control mode switching means of third specification) is composed of the switching circuit 56 and the comparison operation circuit of the temperature regulator 53 as described above. With this arrangement, when the detected temperature Tc of the processing section thermometer 27 is equal to or less than a target vicinity temperature Sc and far from a processing section target temperature Gc, a heating element temperature feed-back control circuit composed of the PID operation circuit of the temperature regulator 51 is employed an electrification control of the induction coil 31, and the processing section temperature feed-back control circuit composed of the PID operation circuit of the temperature regulator 53 is excluded. Further, when the detected temperature Tc of the processing section thermometer 27 exceeds the target vicinity temperature Sc and approaches the processing section target temperature Sc, the heating element temperature feed-back control circuit is excluded from the electrification control of the induction coil 31, and the processing section temperature feed-back control circuit is employed to the electrification control of the induction coil 31 in place of it.

Operation of the control circuits are approximately the same as the operation according to the detected temperatures Ta and Tc in FIG. 6. More specifically, in the superheated steam generator 40 with the temperature control circuit 58, first, the heating element temperature is subjected to the feed-back control executed by the PID operation circuit of the temperature regulator 51, and the heating element temperature is promptly increased while preventing the heating element from being overheated. Next, when there is not a possibility that the heating element is overheated, the processing section temperature is subjected to the feed-back control executed by the PID operation circuit of the temperature regulator 53, thereby the processing section temperature is promptly increased. Thereafter, the processing section temperature is maintained at the target temperature by the feed-back control. As described above, the temperature control is achieved by closing only one loop sequentially selected from the double open/close type feed-back loop. Accordingly, the PID constants of the PID operation circuits of the temperature regulators 51 and 53 can be set without taking interference with other feed-back loops into consideration assuming that there is only one feed-back loop. As a result, the embodiment can be simply applied to various applications likewise the conventional embodiment.

An arrangement of a yet still further embodiment (sixth embodiment) will be explained with reference to the figures. The superheated steam generator of the embodiment is arranged to control the generator of the fourth embodiment by a temperature control circuit 60 shown in an overall control circuit of FIG. 8(*a*) and a temperature control circuit 60 of FIG. 8(*b*).

The sixth embodiment is different from the fourth embodiment in that the temperature control circuit 50 is replaced with the temperature control circuit 60. The temperature control circuit 60 is different from the temperature control circuit 50 described above in that heating element upper limit control mode switching means 57+64 (control mode switching means of fourth specification) are affixed to the temperature control circuit 60, in addition to the temperature control circuit 50 (which will be described in detail in a next seventh embodiment).

Further, an arrangement of the further embodiment (seventh embodiment) will be explained with reference to the figures. The superheated steam generator of the embodiment is arranged to control the generator of the fifth embodiment by a temperature control circuit 70 shown in an overall control circuit of FIG. 9(*a*) and a temperature control circuit 70 of in FIG. 9(*b*).

The seventh embodiment is different from the fifth embodiment in that the temperature control circuit 58 is replaced with the temperature control circuit 70. The temperature control circuit 70 is different from the temperature control circuit 58 described above in that heating element upper limit control mode switching means 57+64 (control mode switching means of fourth specification) are affixed, in addition to the temperature control circuit 50 (which will be described in detail in a next seventh embodiment). The heating element upper limit control mode switching means 57+64 are composed of a comparison operation circuit 57 and a switching circuit 64 described below.

In the temperature control circuits 60 and 70 (refer to FIGS. 8(*b*) and 9(*b*)), the function of the temperature regulator 51 is expanded and the temperature regulator 51 is arranged as a temperature regulator 61, and the temperature regulator 61 is a circuit arranged by adding the comparison operation circuit 57 (CMP.) to the temperature regulator 51 for issuing an alarm for the heating element temperature and executing the feed-back control. The detected temperature Ta of the heating element thermometer 41 is input to the comparison operation circuit 57 as an external signal that is one of to-be-compared objects, and a heating element upper portion management temperature La is set to the comparison operation circuit 57 as the other of the to-be-compared objects. When the detected temperature Ta exceeds the heating element upper portion management temperature La, an employment determination signal Aa1 is output from the comparison operation circuit 57. The heating element upper portion management temperature La (refer to FIG. 10) is set to an appropriate temperature between the heating element target temperature Ga and the heating element upper limit temperature Sa to prevent the detected temperature Ta of the heating element thermometer 41 from exceeding the heating element target temperature Ga and increasing up to an undesired heating element upper limit temperature Sa.

The switching circuit 64 (refer to FIGS. 8(*b*) and 9(*b*)) uses an output from the PID operation circuit of the temperature regulator 61 and an output from the switching circuit 55 as signal inputs (refer to FIG. 8(*b*)) or uses an output from the PID operation circuit of the temperature regulator 61 and an output from the switching circuit 56 as signal inputs (refer to FIG. 9(*b*)), and uses the employment determination signal Aa1 output from the comparison operation circuit 57 as a control input. When the employment determination signal Aa1 is insignificant, the switching circuit 64 employs the output from the switching circuit 55 or 56 and outputs it, whereas when the employment determination signal Aa1 is significant, the switching circuit 64 employs the output from the PID operation circuit of the temperature regulator 61 and outputs it.

The heating element upper limit control mode switching means 57+64 (control mode switching means of fourth specification) is composed of the switching circuit 64 and the comparison operation circuit 57 of the temperature regulator 61. With this arrangement, even if the heating element temperature feed-back control circuit is excluded from the power control of the induction coil 31 and any one of the discharged steam temperature feed-back control circuit and the processing section temperature feed-back control circuit is employed to the power control of the induction coil 31, when the detected temperature Ta of the heating element thermometer 41 deviates upward from the management range of the heating element target temperature Ga (that is, when the detected temperature Ta exceeds the heating element upper portion management temperature La), the heating element temperature feed-back control circuit is employed to the electrification control of the induction coil 31, and the discharged steam temperature feed-back control circuit and the processing section temperature feed-back control circuit are excluded from the power control of the induction coil 31.

Since the heating element upper limit control mode switching means 57+64 is provided, even if there is a possibility that the heating element temperature exceeds the heating element upper limit temperature Sa because the superheated steam generator 25 stops supplying saturated steam while the superheated steam generator is being operated by employing, for example, the discharged steam temperature feed-back control circuit and the processing section temperature feed-back control circuit to the power control of the induction coil 31, when the detected temperature Ta of the heating element thermometer 41 exceeds the heating element upper portion management temperature La, the heating element temperature feed-back control circuit is employed to the power control of the induction coil 31. As a result, since the power of the induction coil 31 is controlled such that the detected temperature Ta of the heating element thermometer 41 approaches the heating element target temperature Ga, the induction coil 31 can be continuously electrified while preventing the heating element temperature from exceeding the heating element upper limit temperature Sa.

FIG. 10 shows operation of the control circuit. Explanation will be made as to an example, in which a saturated steam generator 25 stops supplying saturated steam when the discharged steam temperature feed-back control circuit or the processing section temperature feed-back control circuit is employed in FIG. 10 (refer to time t3), as an example. Since no steam is supplied to a superheated steam generator 40, the discharged steam temperature or the processing section temperature tend to decrease. However, as long as they do not reach the target vicinity temperatures Sb and Sc, respectively, the electrification control, which is executed by the discharged steam temperature feed-back control circuit or the processing section temperature feed-back control circuit, is maintained. However, no steam is supplied to the superheated steam generator 40, the temperatures of the to-be-controlled objects vary without approaching the target temperatures Gb and Gc, and thus there is a high possibility that the detected temperature Ta of the heating element thermometer 41 exceeds the heating element upper limit temperature Sa during the time.

To cope with this problem, the heating element upper portion management temperature La is set between the heating element target temperature Ga and the heating element upper limit temperature Sa, and when the detected temperature Ta of the heating element thermometer 41 exceeds the heating element upper portion management temperature La, the heating element temperature does not exceed the heating element upper limit temperature Sa by excluding the discharged steam temperature feed-back control circuit and the processing section temperature feed-back control circuit from the power control of the induction coil 31 and by employing the heating element temperature feed-back control circuit to the electrification control of the induction coil 31. Then, a steam system restoration processing and the like may be executed during the time.

[Others]

In the respective embodiments described above, although the steam passage of the heating section is composed of the plurality of pipe members, the application of the present invention is not limited thereto, and the present invention can be also applied to a steam passage composed of a single pipe member.

The fourth and sixth embodiments have the three to-be-controlled objects, that is, the heating element temperature, the discharged steam temperature, and the processing section temperature, and the fifth and seventh embodiments have the two to-be-controlled objects, that is, the heating element temperature and the processing section temperature. However, the to-be-controlled objects may be four or more objects including a downstream temperature further added to the above objects, and the sequentially switching system of the feed-back control circuits of the present invention can be applied to any of the cases. Further, although the PID operation is described as an example of the feed-back control, a PI operation and a P operation may be used depending on applications.

BRIEF DESCRIPTION OF THE DRAWINGS

FIG. 1(*a*) to 1(*e*) show a structure and the like of a superheated steam generator of an embodiment (first embodiment) of the present invention, wherein FIG. 1(*a*) is a left elevational view, FIG. 1(*b*) is a front elevational view from which insulators are removed, FIG. 1(*c*) is a left side elevational view in longitudinal cross section, FIG. 1(*d*) is a front elevational view in longitudinal cross section, and FIG. 1(*e*) is a front elevational view in longitudinal cross section of stream passages and the like.

REFERENCE NUMERALS

Figure 1:
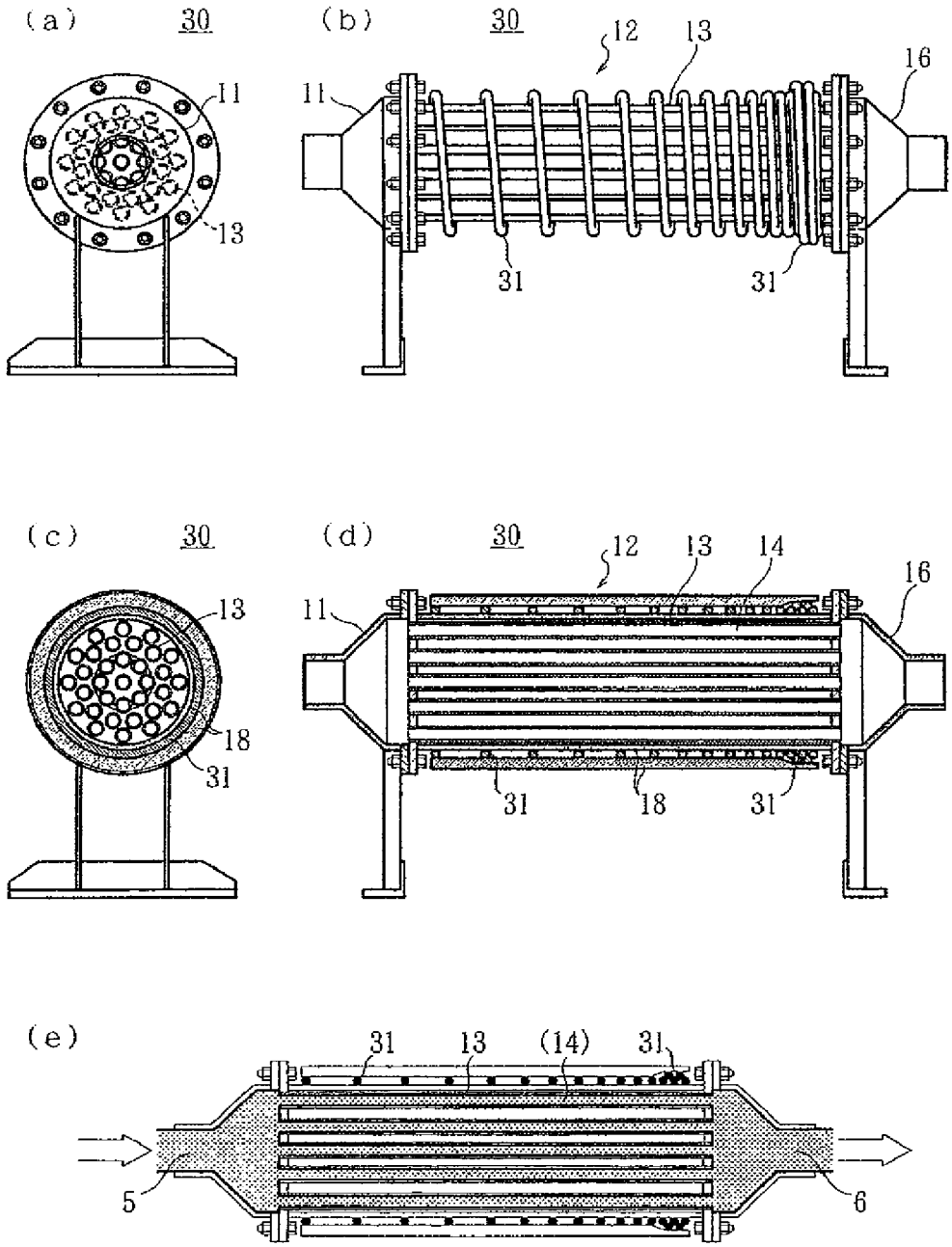
Figure 2:
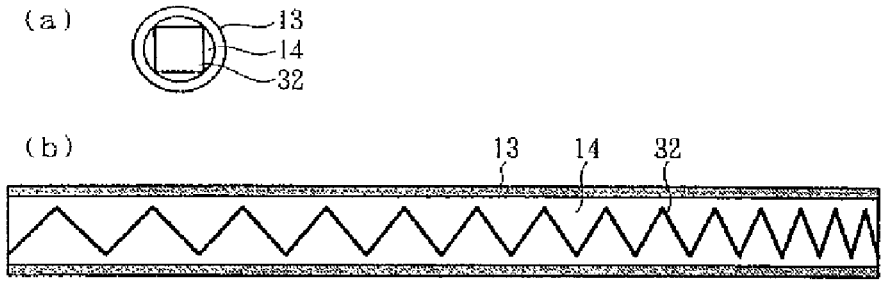
FIGS. 2(*a*) and 2(*b*) show a partial structure of a pipe member and an interference member of another embodiment (second embodiment) of the present invention, wherein FIG. 2(*a*) is a left side elevational view, and FIG. 2(*b*) is a front elevational view in longitudinal cross section.
Figure 3:
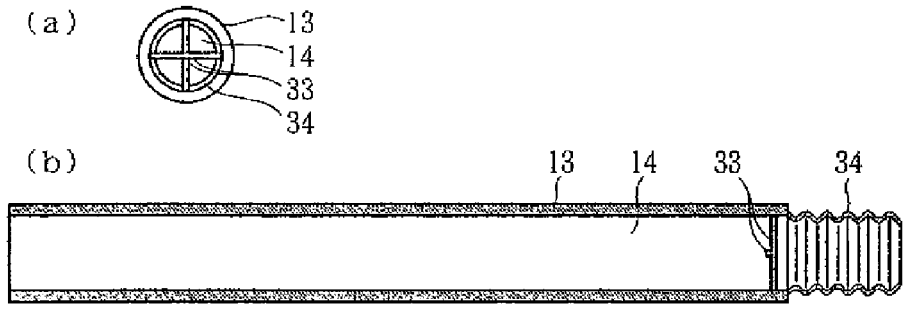
FIGS. 3(*a*) and 3(*b*) show a partial structure of a pipe member and an interference member of still another embodiment (third embodiment) of the present invention, wherein FIG. 3(*a*) is a left side elevational view, and FIG. 3(*b*) is a front elevational view in longitudinal cross section.
Figure 4:
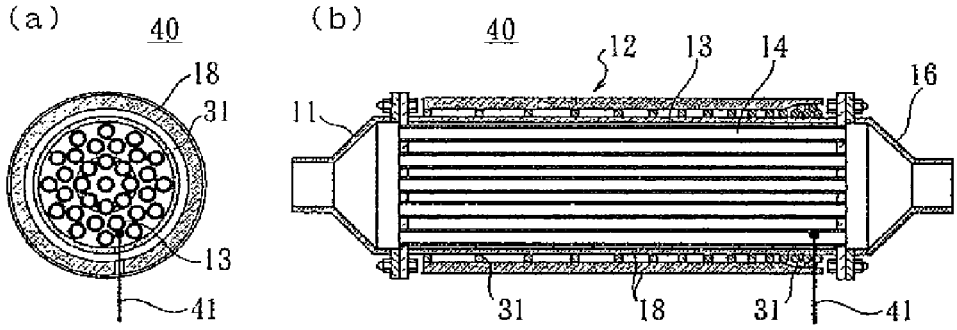
FIGS. 4(*a*) and 4(*b*) show a structure of a main portion of a superheated steam generator of a further embodiment (fourth embodiment) of the present invention, wherein FIG. 4(*a*) is a left side elevational view in longitudinal cross section, and FIG. 4(*b*) is a front elevational view in longitudinal cross section.
Figure 5:
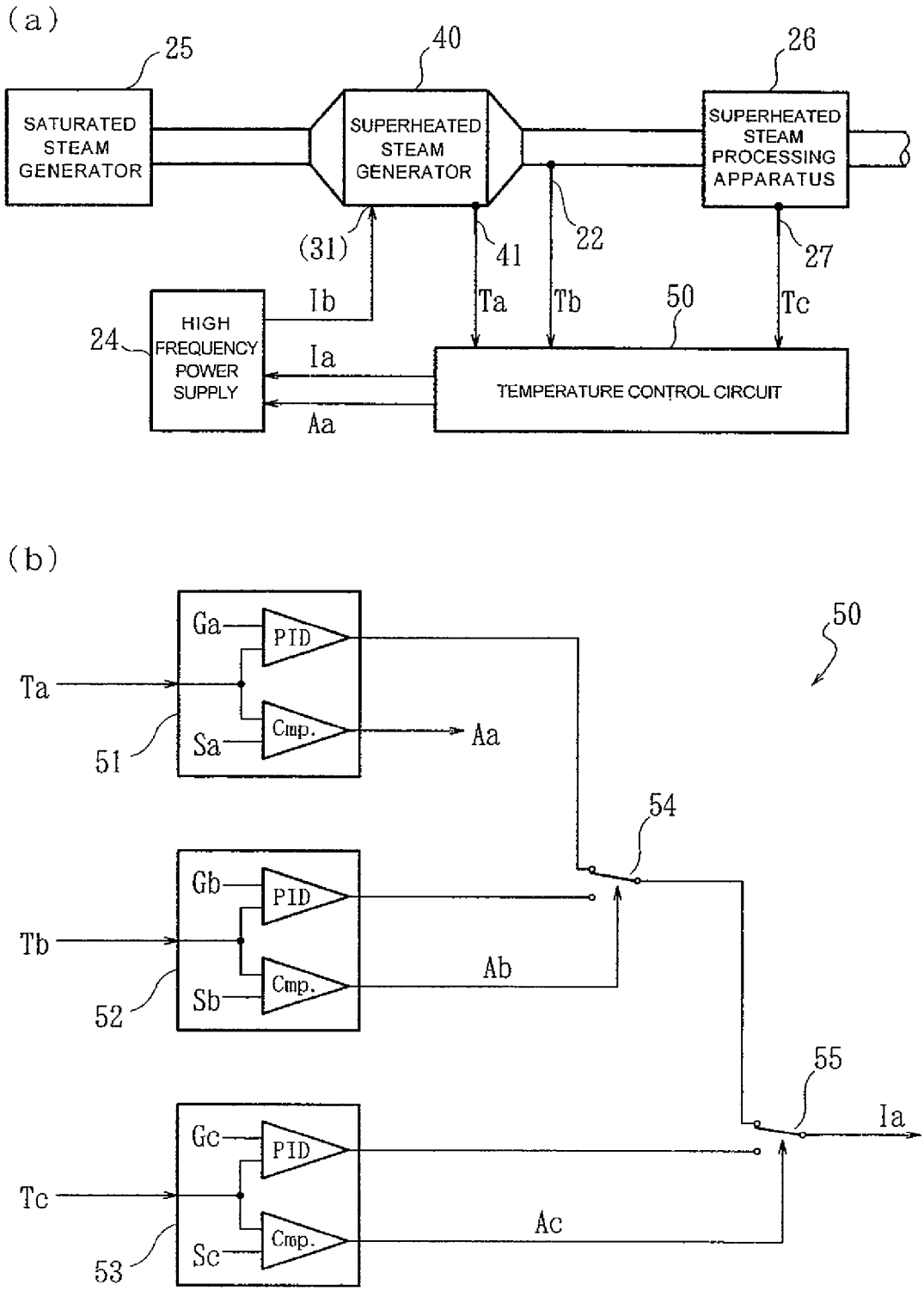
FIG. 5(*a*) shows an overall block diagram including a temperature control circuit and other associating apparatuses, and FIG. 5(*b*) is a block diagram of the temperature control circuit.
Figure 6:
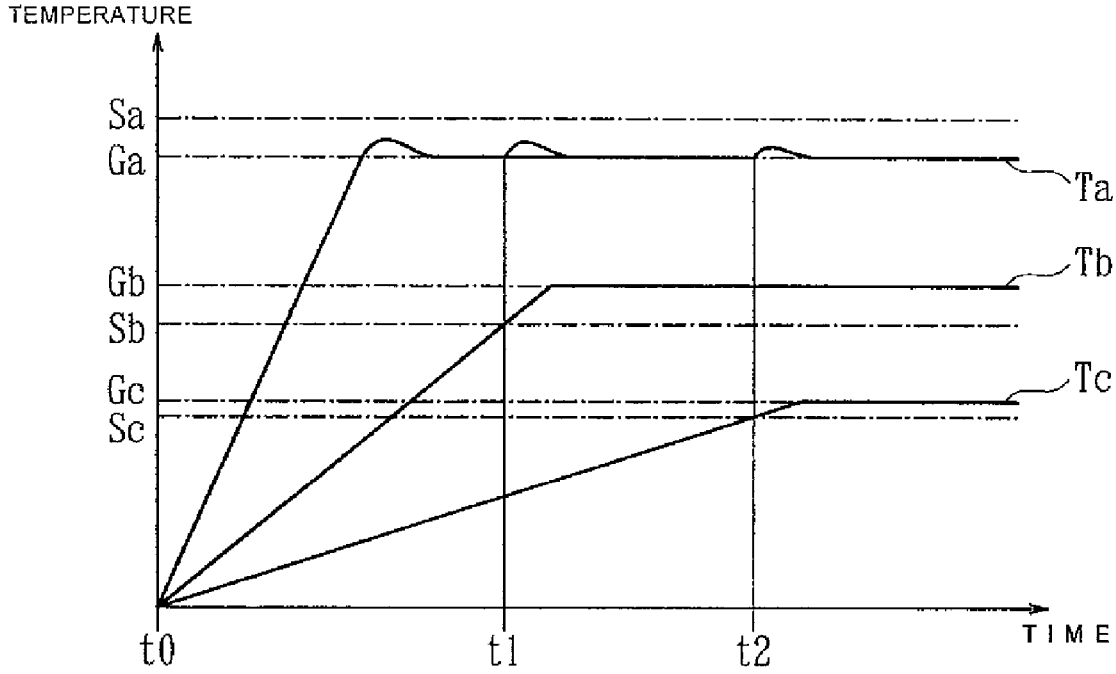
FIG. 6 is a time chart of a temperature change.
Figure 7:
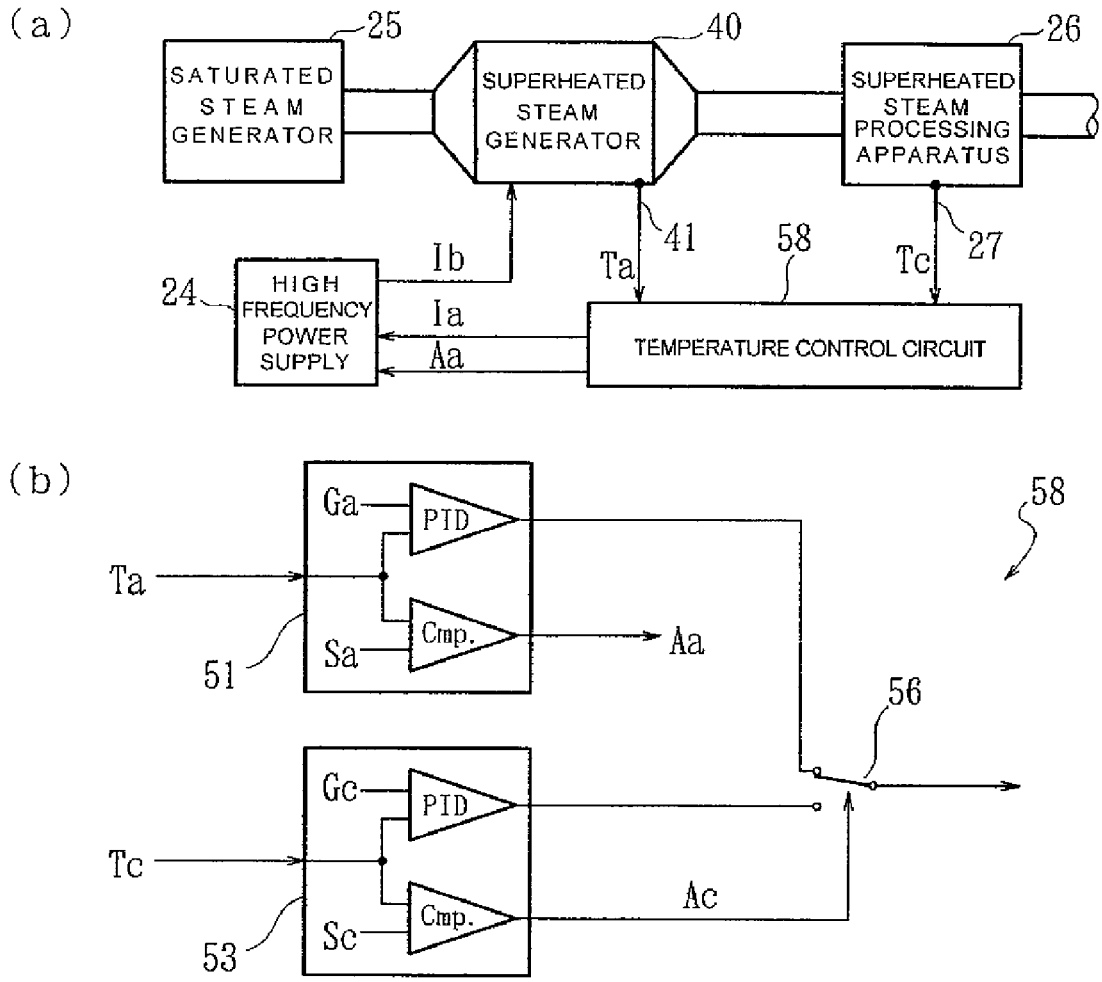
FIGS. 7(*a*) and 7(*b*) show a control structure of a superheated steam generator of a still further embodiment (fifth embodiment) of the present invention, wherein FIG. 7(*a*) is an overall block diagram including a temperature control circuit and associating apparatuses, and FIG. 7(*b*) is a block diagram of the temperature control circuit.
Figure 8:
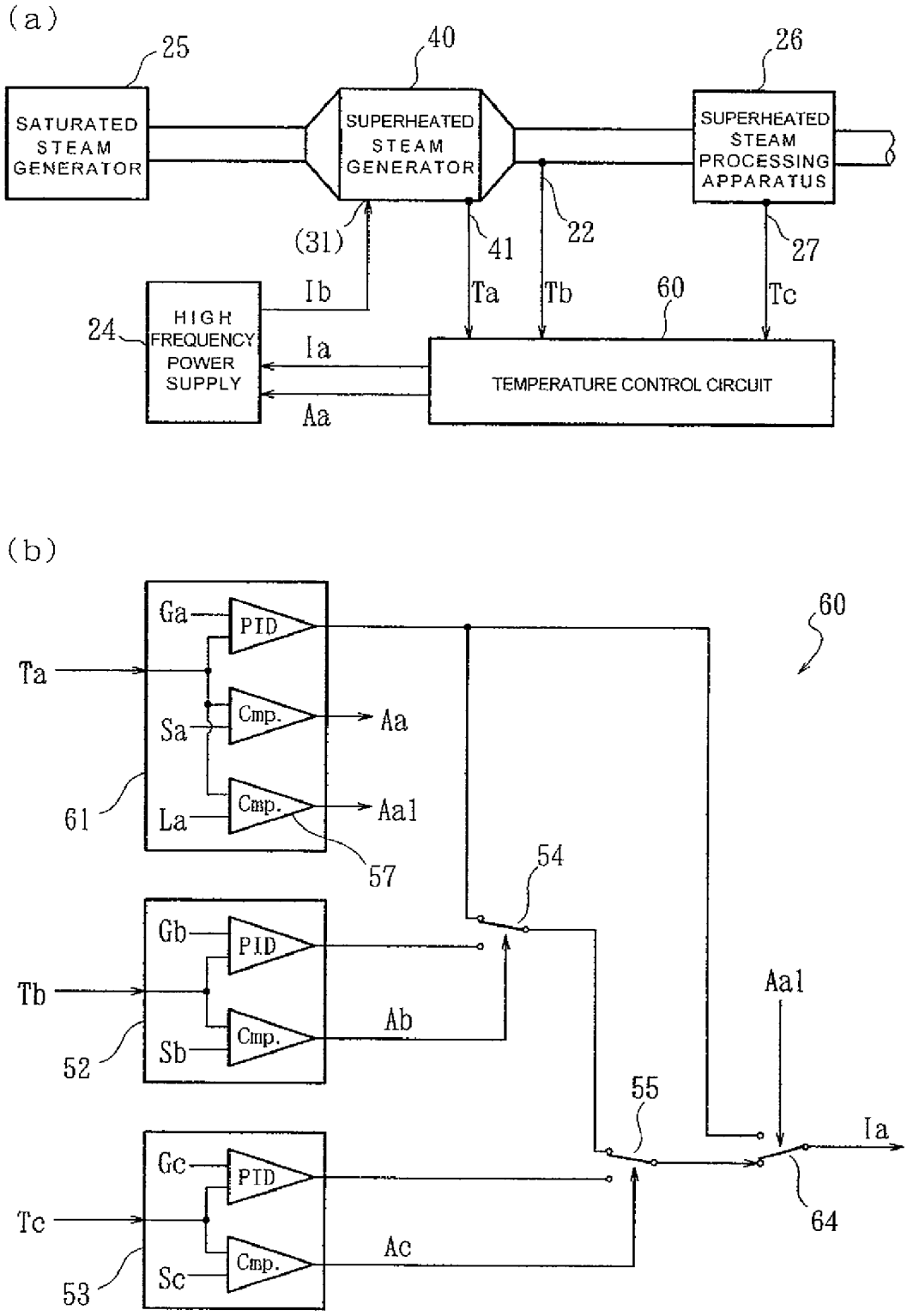
FIGS. 8(*a*) and 8(*b*) show a control structure of a superheated steam generator of a yet still further embodiment (sixth embodiment) of the present invention, wherein FIG. 8(*a*) is an overall block diagram including a temperature control circuit and associating apparatuses, and FIG. 8(*b*) is a block diagram of the temperature control circuit.
Figure 9:
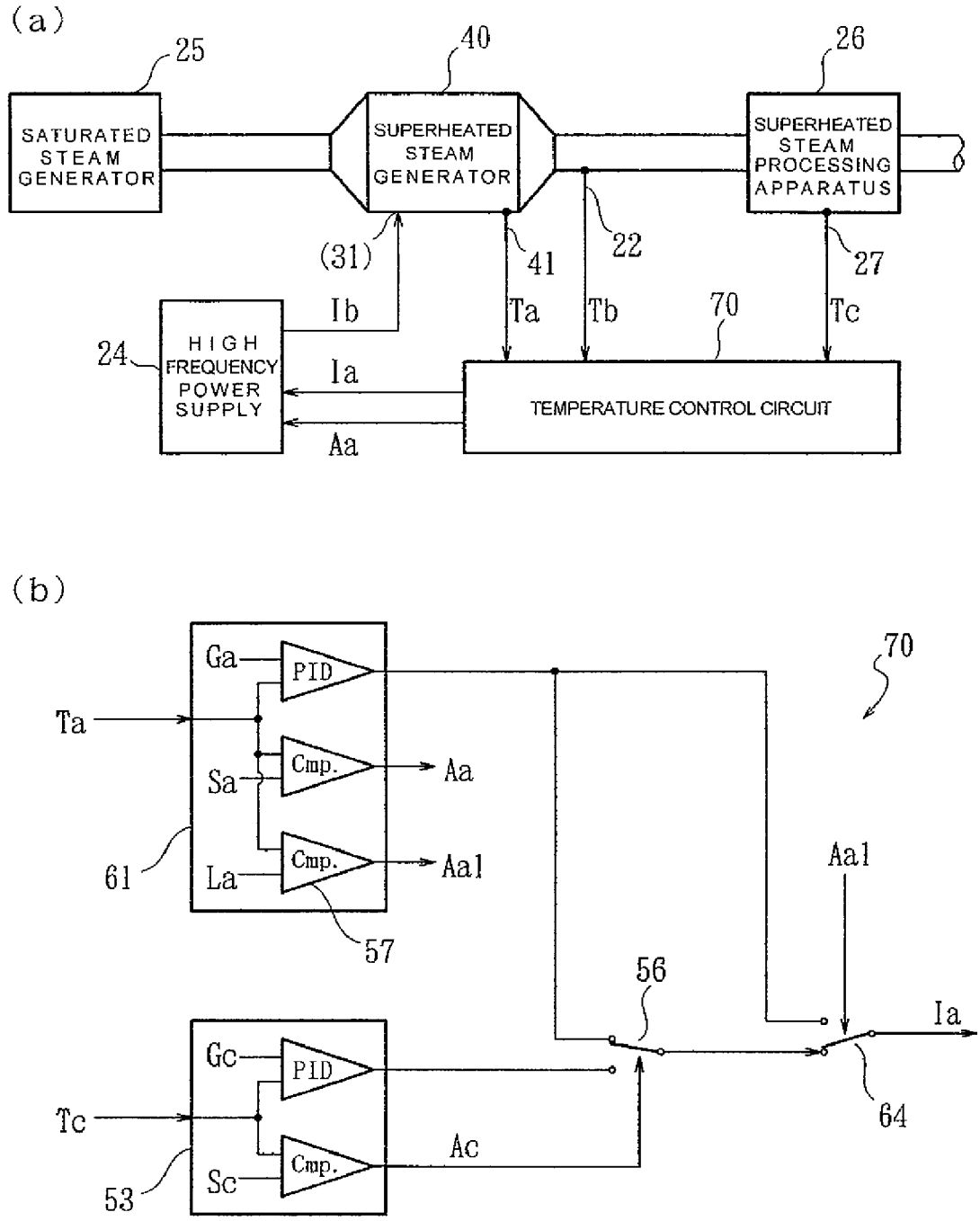
FIGS. 9(*a*) and 9(*b*) show a control structure of a superheated steam generator of a further embodiment (seventh embodiment) of the present invention, wherein FIG. 9(*a*) is an overall block diagram including a temperature control circuit and associating apparatuses, and FIG. 9(*b*) is a block diagram of the temperature control circuit.
Figure 10:
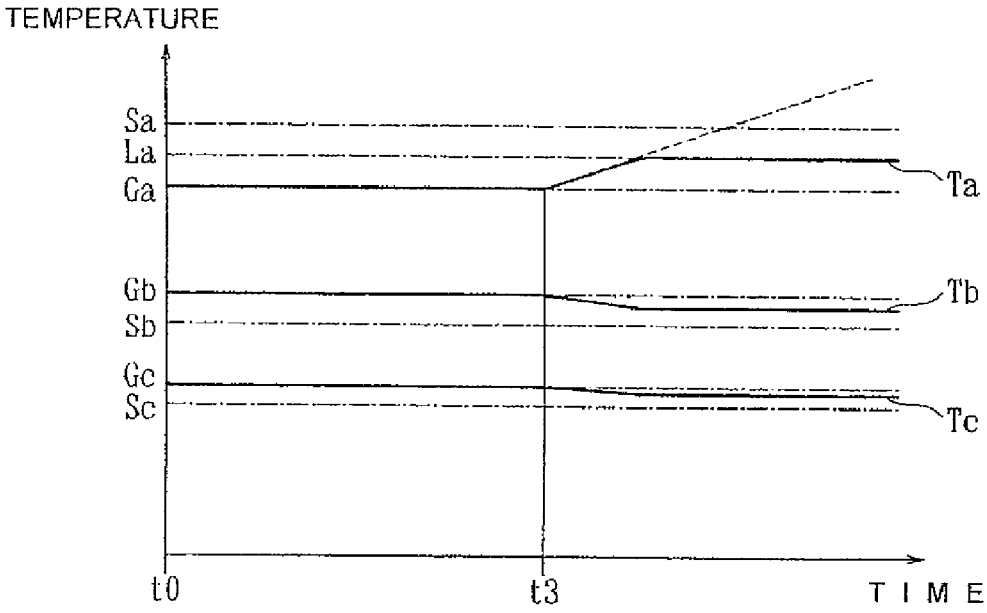
FIG. 10 is a time chart of a temperature change.
Figure 11:
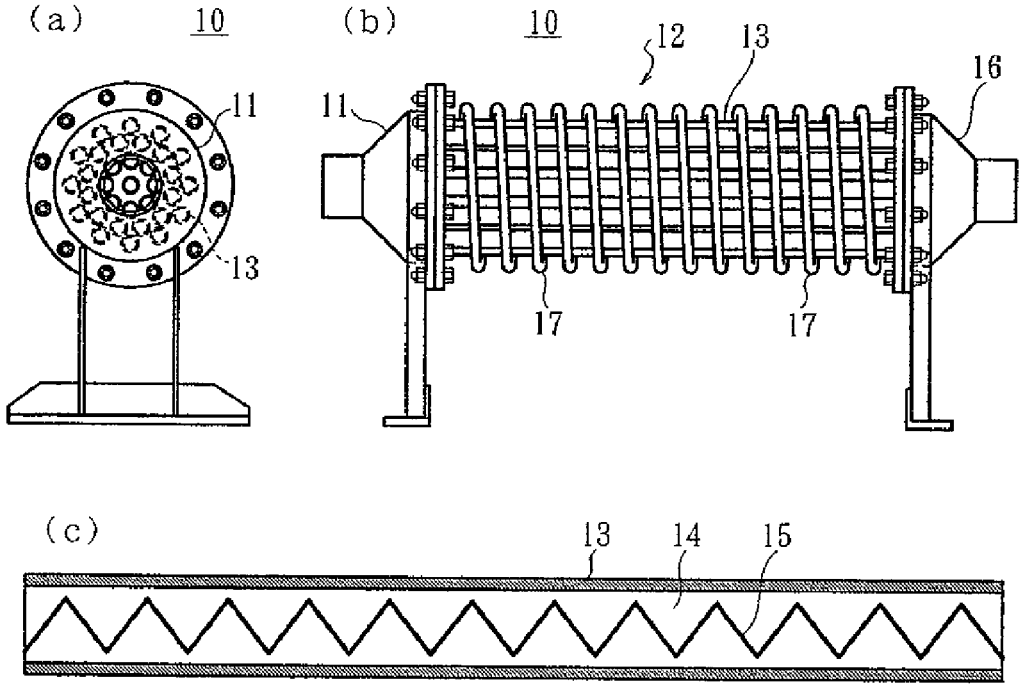
FIG. 11(*a*) to 11(*c*) show a structure of a conventional superheated steam generator, wherein FIG. 11(*a*) is a left side elevational view, FIG. 11(*b*) is a front elevational view from which insulators are removed, and FIG. 11(*c*) is a front elevational view in longitudinal cross section of the portion of a pipe member and an interference member.
Figure 12:
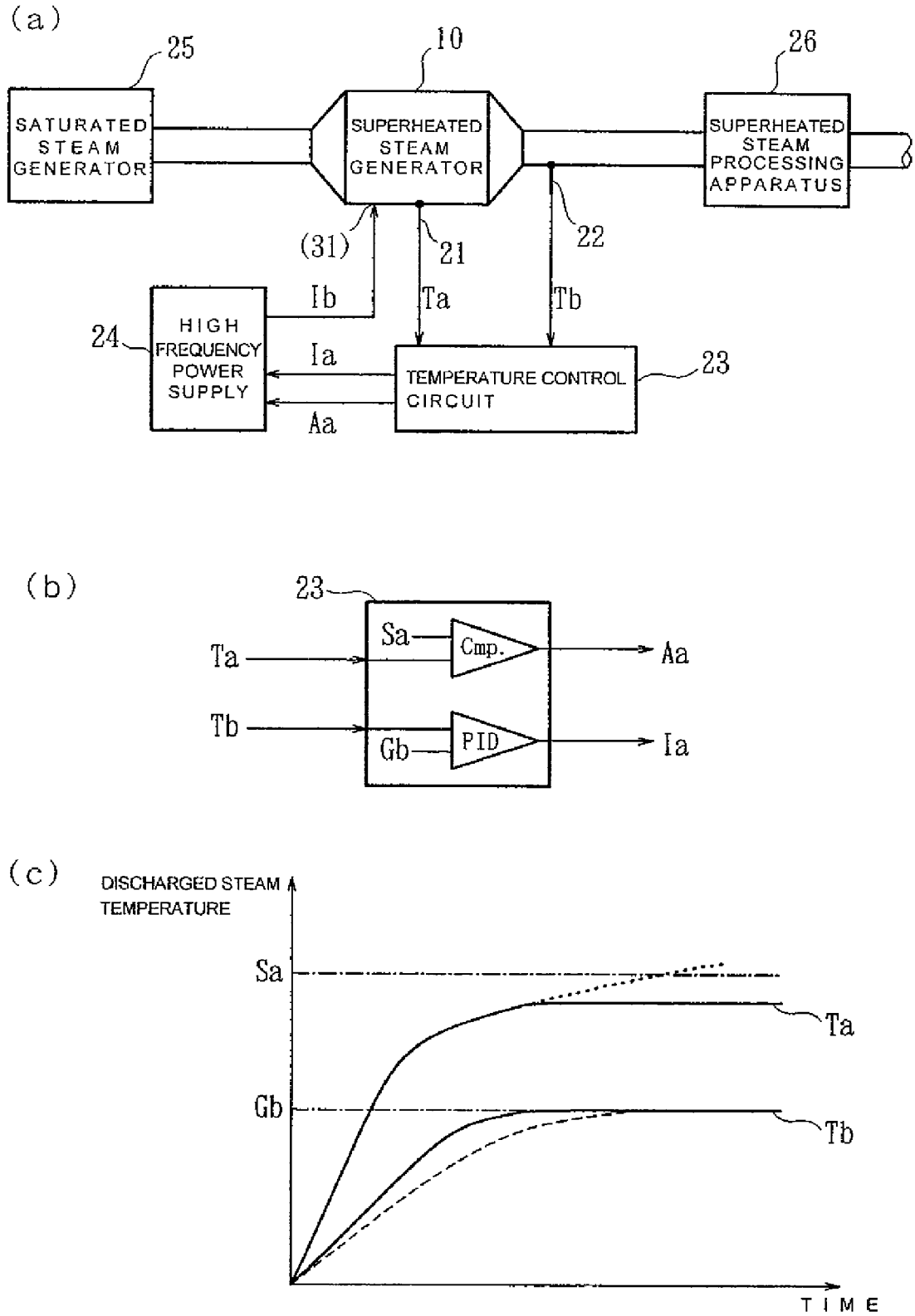
FIG. 12(*a*) is an overall block diagram including a temperature control circuit and other associating apparatuses, FIG. 12(*b*) is a block diagram of the temperature control circuit, and FIG. 12(*c*) is a time chart of a temperature change.
Figure 13:
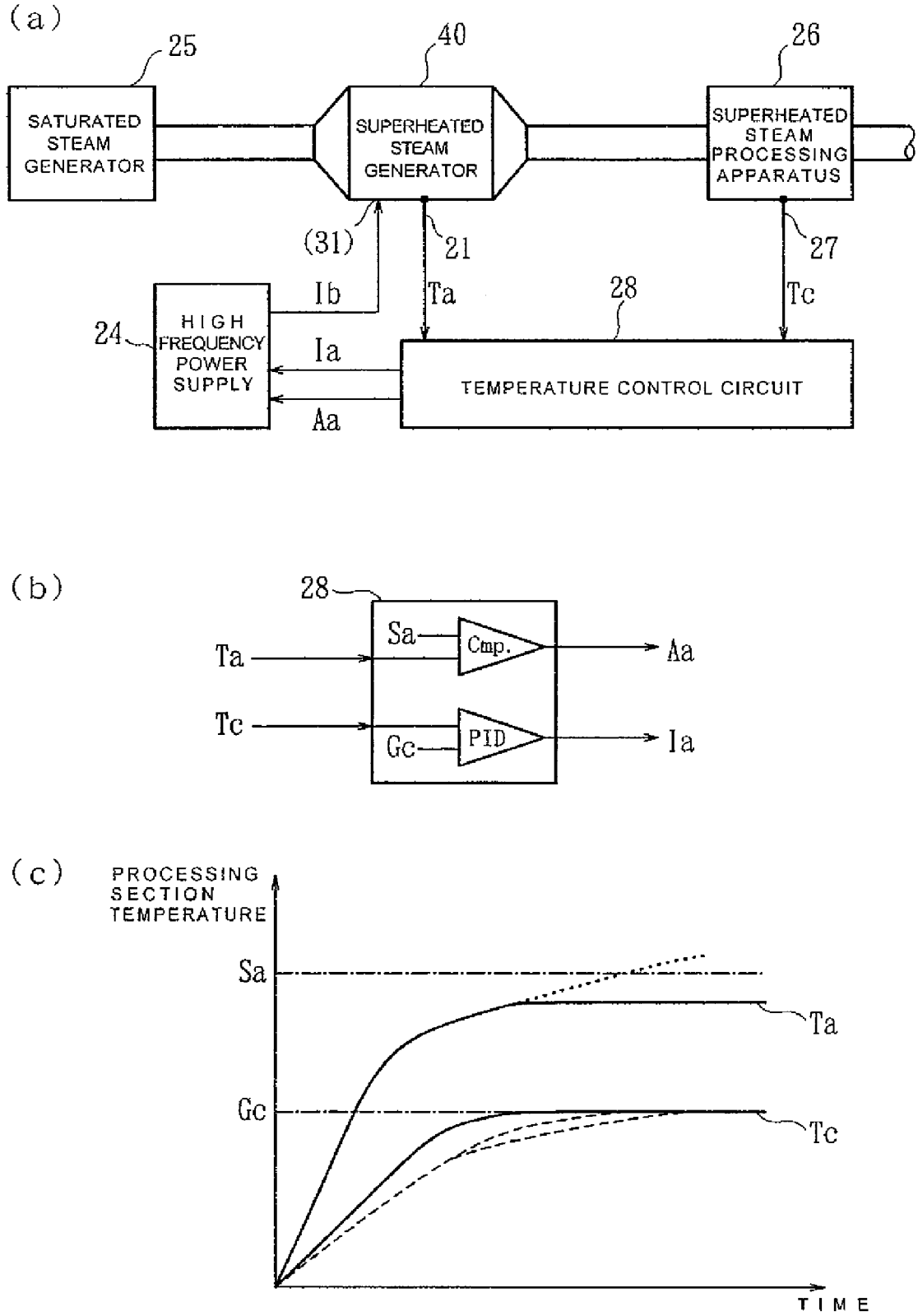
FIG. 13(*a*) is an overall block diagram including a temperature control circuit and other associating apparatuses, FIG. 13(*b*) is a block diagram of the temperature control circuit, and FIG. 13(*c*) is a time chart of a temperature change.

5 . . . saturated steam, 6 . . . superheated steam, 10 . . . superheated steam generator main body, 11 . . . introduction section, 12 . . . heating section, 13 . . . pipe member (heating element), 14 . . . hollow portion (steam passage), 15 . . . corrugated sheet, 16 . . . discharge section, 17 . . . induction coil, 18 . . . insulator, 21 . . . heating element thermometer, 22 . . . discharged steam thermometer, 23 . . . temperature control circuit, 24 . . . high frequency power supply, 25 . . . saturated steam generator, 26 superheated steam processing apparatus, 27 . . . processing section thermometer, 28 . . . temperature control circuit, 30 . . . superheated steam generator, 31 . . . induction coil, 32 . . . corrugated sheet, 33 . . . interference bar, 34 . . . bellows-shaped member, 40 . . . superheated steam generator, 41 . . . heating element thermometer, 50 . . . temperature control circuit, 51, 52, 53 . . . temperature regulator, 54, 55, 56 . . . switching circuit, 57 . . . comparison operation circuit, 58, 60 . . . temperature control circuit, 61 . . . temperature regulator, 64 . . . switching circuit, 70 . . . temperature control circuit, Ta, Tb, Tc . . . detected temperature, Sa . . . heating element upper limit temperature, Sb, Sc . . . target vicinity temperature, La . . . heating element upper portion management temperature, Ga . . . heating element target temperature, Gb . . . discharged steam target temperature, Gc . . . processing section target temperature, Aa . . . alarm signal, Ia . . . electrification command, Ib . . . coil current

The invention claimed is:

1. A superheated steam generator, comprising an introduction section for introducing saturated steam, a heating section for heating the saturated steam and making it to become a superheated steam in which a plurality of conductive pipe members are disposed in parallel with each other, the hollow portions of the plurality of the pipe members are arranged as steam flow passages, and the pipe members themselves are caused to also act as inductively heated elements, a discharge section for discharging the superheated steam, and an induction coil wound around the heating section, wherein turbulent steam flow generating means is disposed in each of the steam flow passages of the heating section to accelerate transfer of heat from the pipe members to the steam in the pipe members and generates much turbulence near to the discharge section, wherein the turbulent flow generating means is a zigzag bent member disposed in the steam flow passage of the heating section, and a zigzag bending pitch of the bent member changes from rough to minute from the introduction section to the discharge section;

wherein a winding density of the induction coil changes from rough to minute from the introduction section to the discharge section.

2. The superheated steam generator according to claim 1, wherein the turbulent flow generating means is a bellows-shaped pipe wall formed of a pipe wall constituting the portion of the pipe member near to the discharge section.

3. The superheated steam generator according to claim 1, comprising a heating element thermometer that detects a temperature of a heating element having the pipe member of the heating section and has a detection end attached to the pipe member, a heating element temperature feed-back control circuit for executing a power control of the induction coil so that a detected temperature of the heating element thermometer converges to a heating element target temperature, a discharged steam thermometer having a detection end disposed to the discharge section or downstream of the discharge section, a discharged steam temperature feed-back control circuit for executing the power control of the induction coil so that the detected temperature of the discharged steam thermometer converges to a discharged steam target temperature; and either heating element or discharged steam control mode switching means for setting a first mode in which, when the detected temperature of the discharged steam thermometer is far from the discharged steam target temperature, the heating element temperature feed-back control circuit is employed and the discharged steam temperature feed-back control circuit is suspended in the power control of the induction coil, and for setting a second mode in which, when the detected temperature of the discharged steam thermometer approaches the discharged steam target temperature, the heating element temperature feed-back control circuit is suspended and the discharged steam temperature feed-back control circuit is employed in the power control of the induction coil.

4. The superheated steam generator according to claim 3, further comprising a processing section thermometer having a detection end disposed to a processing section which has been disposed or is to be disposed downstream of the discharge section, and a processing section temperature feed-back control circuit for executing the power control of the induction coil so that a detected temperature of the processing section thermometer converges to a processing section target temperature; and heating element or discharged steam or processing section control mode switching means for setting a first mode in which, when the detected temperature of the processing section thermometer is far from the processing section target temperature, a result of employment of the heating element or discharged steam control mode switching means is employed and the processing section temperature feed-back control circuit is suspended in the power control of the induction coil, and for setting a second mode, in which, when the detected temperature of the processing section thermometer approaches the processing section target temperature, the heating element or discharged steam control mode switching means is suspended and the processing section temperature feed-back control circuit is employed in the power control of the induction coil.

5. The superheated steam generator according to claim 3, comprising one heating element upper limit control mode switching means for employing the heating element temperature feed-back control circuit and suspending either the discharged steam temperature feed-back control circuit or the processing section temperature feed-back control circuit, when the detected temperature of the heating element thermometer deviates upward from a control range of the heating element target temperature, in a state that the heating element temperature feed-back control circuit is suspended and any one of the discharged steam temperature feed-back control circuit and the processing section temperature feed-back control circuit is employed.

6. The superheated steam generator according to claim 1, comprising a heating element thermometer that detects a temperature of a heating element comprising the pipe member of the heating section and has a detection end attached to the pipe member, a heating element temperature feed-back control circuit for executing the power control of the induction coil so that the detected temperature of the heating element thermometer converges to a heating element target temperature, a processing section thermometer having a detection end disposed to a processing section which has been disposed or is to be disposed downstream of the discharge section, a processing section temperature feed-back control circuit for executing the power control of the induction coil so that a detected temperature of the processing section thermometer converges to a processing section target temperature; and heating element or processing section control mode switching means for setting a mode in which, when the detected temperature of the processing section thermometer is far from the processing section target temperature, the heating element temperature feed-back control circuit is employed and the processing section temperature feed-back control circuit is suspended in the power control of the induction coil, and for setting a mode in which, when the detected temperature of the processing section thermometer approaches the processing section target temperature, the heating element temperature feed-back control circuit is suspended and the processing section temperature feed-back control circuit is employed in the power control of the induction coil.

7. The A superheated steam generator of claim 1, wherein the zigzag bent member disposed in the steam flow passage of the heating section is a corrugated plate member disposed inside a tubular flow passage.

* * * * *